United States Patent [19]

Hoshi

[11] Patent Number: 5,075,730

[45] Date of Patent: Dec. 24, 1991

[54] APPARATUS AND METHOD FOR FORMING AN IMAGE

[75] Inventor: Nobuyoshi Hoshi, Katsuta, Japan

[73] Assignee: Hitachi, Ltd., Tokyo, Japan

[21] Appl. No.: 661,302

[22] Filed: Feb. 27, 1991

[30] Foreign Application Priority Data

Feb. 28, 1990 [JP] Japan ..... 2-45831

[51] Int. Cl.[5] ..... G03G 15/14; G03G 15/01

[52] U.S. Cl. ..... 355/271; 355/326; 355/327

[58] Field of Search ..... 355/326, 327, 271, 277, 355/245, 328

[56] References Cited

U.S. PATENT DOCUMENTS

| | | | |
|---|---|---|---|
| 4,742,371 | 5/1988 | Furuta et al. | 355/327 |
| 4,751,549 | 6/1988 | Koizumi | 355/327 |
| 4,769,672 | 9/1988 | Hoshi et al. | 355/327 |
| 4,806,972 | 2/1989 | Tomoyori et al. | 355/327 |
| 4,956,676 | 9/1990 | Fukae et al. | 355/271 |
| 4,984,026 | 1/1991 | Nishise et al. | 355/271 X |
| 4,987,455 | 1/1991 | Lubberts | 355/271 |
| 5,017,969 | 5/1991 | Mitomi et al. | 355/271 |
| 5,027,158 | 6/1991 | Tompkins et al. | 355/271 |

FOREIGN PATENT DOCUMENTS

| | | |
|---|---|---|
| 0191664 | 11/1982 | Japan . |
| 0065454 | 4/1983 | Japan . |
| 0067873 | 4/1986 | Japan . |
| 0178987 | 8/1987 | Japan . |
| 0040860 | 2/1989 | Japan . |
| 0147481 | 6/1989 | Japan . |

*Primary Examiner*—A. T. Grimley
*Assistant Examiner*—Sandra L. Brase
*Attorney, Agent, or Firm*—Antonelli, Terry, Stout & Kraus

[57] ABSTRACT

In order to form an image being e.g. a color image formed by an electrophotographic process, toner images are formed on a recording medium by transcription assemblies corresponding to each color of the final image. The recording medium has a continuously looped shape and that looped shape has curved parts which are all curved in the same direction. Thus, the recording medium may be in the form of an endless belt passing around rollers, which is thus an un-convoluted shape. The transcription assemblies are spaced apart along the path of the recording medium. An intermediate transfer medium contacts the recording medium at transfer sites between the transcription assemblies so that a toner image can be transferred between the recording medium and the intermediate transfer medium from the transcription assembly preceding each transfer site. Thus, a superimposed image may be formed on the intermediate transfer medium, for subsequent transfer to a print medium. Alternatively, a plurality of toner images may be transferred to a print medium directly from the recording medium, or some toner images may be formed on the intermediate transfer medium and retransferred to the recording medium.

38 Claims, 13 Drawing Sheets

APPARATUS AND METHOD FOR FORMING AN IMAGE

BACKGROUND OF THE INVENTION

1. FIELD OF THE INVENTION

The present invention relates to an apparatus for forming an image. Particularly, but not exclusively, the present invention is concerned with forming a colour image by an electrophotographic process, which image is preferably a multi-colour or full colour image. The present invention also relates to a method of forming such an image.

SUMMARY OF THE PRIOR ART

When forming an image of a single colour by an electrophotographic process, it is well known to form a toner image on a recording medium in the form of a cylinder, with the toner image subsequently being transferred from that cylinder to a print medium such as a paper sheet. An electrostatic pattern is formed on the cylinder, by photo-exposure, and then toner of the desired colour is electrostatically adhered to the cylinder in the desired pattern, and subsequently transferred to the print medium.

When applying this technique to multi-colour printing, it has been proposed that the cylnder, forming the recording medium, rotates as many times as there are colours to be printed, with a different toner being transferred each time. The print medium, such as a paper sheet, is then caused to interact with the cylinder a corresponding plurality of times, so that a toner image of each colour is transferred sequentially to the paper sheet.

Examples of such an arrangement are known from JP-A-61-67873, JP-A-58-65454, and U.S. Pat. No. 4,751,549 (equivalent to JP-A-62-239179). In the latter case the recording medium is in the form of an endless belt, rather than a cylinder, the belt following a convoluted path.

It is also known to transfer a plurality of toner images representing different colours to a recording medium, with the images being superimposed, and then to transfer the superimposed images to the print medium, and an example of this, using a recording medium in the form of a belt, is shown in JP-A-57-191664.

In the above cases, there is only one assembly for forming the electrostatic images, with that assembly serving each toner colour sequentially. However, it is also known to provide a separate electrostatic pattern assembly for each toner colour, with those assemblies being spaced around a recording cylinder.

In all the above cases, the toner images are transferred directly from the recording medium (cylinder) to the print medium (paper). It is also known to provide an intermediate transfer medium on which the toner images are superimposed prior to their transfer to the print medium. Thus, for example, in the case of U.S. Pat. No. 4,751,549, the toner images which are formed successively on each rotation of the belt could be transferred sequentially to an intermediate transfer member, so that they are all superimposed, and then transferred to a print medium. Alternatively, as in JP-A-64-40860 and JP-A-62-178987, a separate recording medium can be provided for each colour of toner, and each recording medium then transfers its toner to the intermediate transfer medium, so that all the toner images are superimposed, and the intermediate transfer medium them transfers the superimposed images to the print medium.

A further arrangement is disclosed in U.S. Pat. No. 4,769,672 (equivalent to JP-A-63-60473). In this disclosure, the recording medium follows a convoluted path, with U-shaped sections, which interact with a print medium at the ends of the legs of the U-shapes sections. Respective toner images are then formed within the loop of each U-shape, so each leg transfers a toner image which has been formed on the recording medium in the proceeding loop of the U-shape.

Finally, it is known from JP-A-1-147481 to form a first toner image at one part of a recording medium in the form of a cylinder, transfer that image to a print medium such as paper at a first transfer site, form another image on the cylinder as it rotates, and then transfer that second image to the print medium at a second transfer site spaced from the first transfer site, with the printing medium following a U-shape between the first transfer site and the second.

SUMMARY OF THE INVENTION

In arrangements such as U.S. Pat. No. 4,751,549, where a recording member in the form of a cylinder or belt rotates as many times as there are colours to be printed, the speed of printing is slow. The rate of rotation of the cylinder or belt is determined by existing technology, and in practice it is not possible to achieve speeds greater than 6 pages/per minute for four colour printing. It should be noted here that, by "four colour" it is intended that black be one of those colours, and the other colours be red, green and blue, or cyan, magenta, and yellow. Furthermore, when the print medium (paper) has itself to interact a plurality of times with to the recording medium, the mechanisms for achieving this are prone to causing buckling of the print medium, and the risk of this is increased with the number of interactions. Therefore, the liklihood of successful printing is reduced.

Where each toner colour has a separate electrostatic assembly associated therewith, speed can be increased, because only one rotation of the recording medium is needed, but the size of the apparatus increases unacceptably.

In arrangements such as JP-64-40860, in which an intermediate transfer medium is used, printing speed can also be increased. In practice, speeds of up to 15 pages/-minute are possible. However, again the apparatus needs to be large.

The arrangement disclosed in U.S. Pat. No. 4,769,672 has the advantage of printing in a single pass (interaction) of the print medium, without excessive increase in the size of the apparatus, by convoluting the recording medium. However, it has been appreciated by the applicants that such an arrangement is undesirable, for two reasons. Firstly, the recording medium itself needs to be replaced at regular intervals, and it is difficult to position the recording medium accurately when it follows a convoluted path.

There is a further problem with the arrangement of U.S. Pat. No. 4769672. When considering the path of the belt-like recording member, it can readily be appreciated that the direction of movement of the belt changes around the path, and that the belt has two different directions in which its path changes, clockwise and anti-clockwise. For one direction (changes of direction which are clockwise in the drawings of U.S. Pat. No. 4,769,672), the changes in direction can be achieved by passing the belt around a roller making contact with the inside surface of the belt. However, for anti-clockwise changes, it is not possible to provide a roller on the outside of the belt because such a roller would interfere with toner images formed on the outside of the belt. Therefore, the convoluted path of U.S. Pat. No. 4,769,672, involving both clockwise and anti-clockwise changes in direction, is not satisfactory.

Therefore, in order to overcome this, the present invention proposes that the recording medium follow a looped path in which changes in direction are such that the curved parts of the recording medium are curved in one direction only. Then, a further medium is provided which interacts with the recording medium at a plurality of toner transfer sites, with the further medium being spaced from the recording medium between those transfer sites.

However, it may be appreciated that a recording medium in the form of a cylinder has curved parts curved in one direction only. The situation is thus then similar to JP-A-1-147481. However, in JP-A-1-147481, the print medium must follow a convoluted path interacting with the recording medium at a plurality of sites, and there is then a risk of buckling the printer medium when the printer medium is relatively thin, such as paper.

Therefore, according to a first aspect of the present invention, the present invention proposes that there is a intermediate transfer belt to which the recording medium transfers toner images, and when some or all of the images have been transferred to that intermediate transfer belt, the images are transferred to a print medium, or back to the recording medium for subsequent transfer to a print medium.

Thus, where such an intermediate transfer medium is provided, it will interact with the recording medium at a plurality of sites, with a toner image being transferred between the recording medium and the intermediate transfer medium at each site. These sites are intermediate to locations where the toner images are formed by respective transcription assemblies.

The most straightforward arrangement of such an apparatus is for a toner image to be transferred to the intermediate transfer medium, at each transfer site, so that all the images are superimposed, and the superimposed toner images can be transferred in a single operation to the print medium. However, it is also possible to re-transfer one or more toner images from the intermediate transfer medium to the recording medium at the last transfer site in the sequence along the recording medium. Then, the superimposed toner images are transferred from the recording medium to the print medium. The advantage of such an arrangement is that if the apparatus is to be changeable between single colour and multi-colour printing, for the case of a single colour the intermediate transfer medium need not be used enabling the apparatus to achieve the high speed of standard single colour printing.

With such an intermediate transfer medium, the recording medium may be in the form of an endless belt passing round two or more rollers, or may be a cylinder. In either case, its shape is such that it curves in only one direction, and it is therefore simpler to replace than the recording medium with convoluted shape of U.S. Pat. No. 4,769,672. The use of an endless belt passing around rollers has advantages when considering the size of the apparatus, particularly for multi-colour arrangements, and the use of such an endless belt is therefore an independent aspect of the present invention. Such an arrangement will also enable there to be a straight path for the recording medium between adjacent pairs of sites where tone images are transferred if desired.

In a four-colour printing apparatus, maximum printing speed is normally achieved if there is a separate transcription assembly for each colour. However, such an apparatus will then be large. To overcome this, it is possible for each transcription assembly to be capable of transferring two colours, and for two such transcription assemblies to be provided. Then, in a first rotation of a recording medium, first and second toner images are formed sequentially, and transferred to a further medium being either an intermediate transfer medium or a print medium, and then two further colours are sequentially formed on the recording medium in a subsequent rotation. Then there are two possible arrangements. Firstly, the images in the two further colours may be superimposed in the original two images as the further medium. Where the further medium is the print medium this forms the four colour image thereon. Where the further medium is an intermediate transfer medium, the four colour image formed thereon may then be transformed to the print medium in a single step. Secondly, where the further medium is an intermediate transfer medium it is possible to transfer the original two images thereto prior to the formation of the further two images, and transfer the further two images in a subsequent interaction of the print and intermediate transfer medium, thereby to form a four colour image on the print medium.

Either of these arrangements has the disadvantage of requiring two rotations of the recording medium, and thereby slowing the printing speed, but since only two transcription assemblies are needed, the size of the apparatus can be reduced. These arrangements, in which there are two rotations of the recording medium, and two colour toner images are formed each rotation, represent another independent aspect of the present invention.

Each transcription assembly may be a toner image-forming unit with units for forming an electrostatic charge, means for exposing that electrostatic charge to form a pattern, and a developing unit for forming a toner image corresponding to the pattern on the recording medium. However, the present invention is not limited to such a toner image-forming unit.

BRIEF DESCRIPTION OF THE DRAWINGS

The present invention will now be described in detail, by way of example, with reference to the accompanying drawings in which.

DETAILED DESCRIPTION

Figure 1:
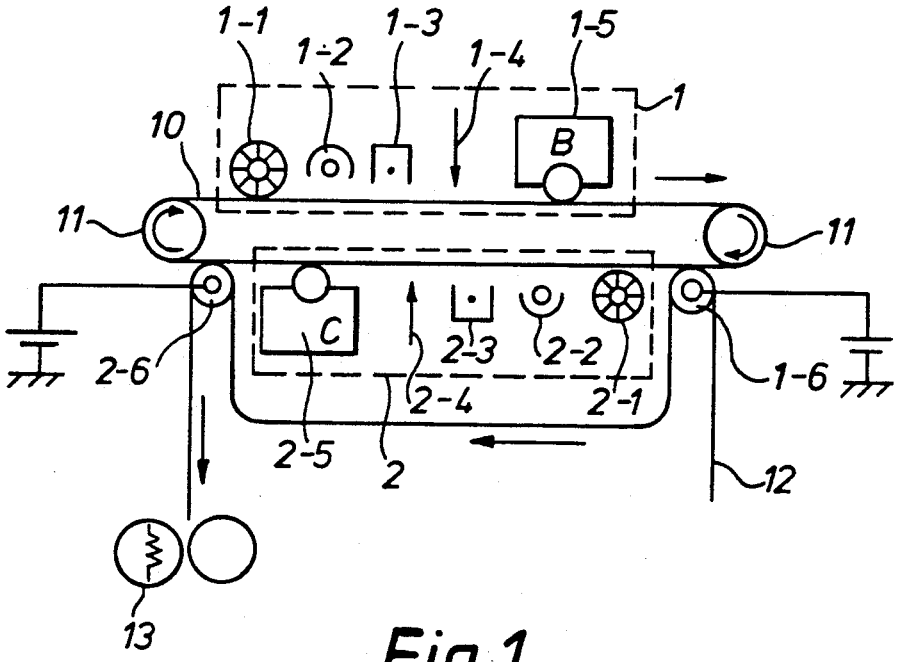
FIG. 1 shows a first embodiment of the present invention, being an apparatus for forming a two-colour image.

FIG. 1 is a block diagram showing the construction of the first embodiment of the present invention.

Referring to FIG. 1, an apparatus for forming two-colour image has a first transcription assembly 1, cleaners 1-1 and 2-1, erasers 1-2 and 2-2, charging units 1-3 and 2-3, exposure portions 1-4 and 2-4, developing units 1-5 and 2-5, transferring unit 1-6 and 2-6, a second transcription assembly 2, a recording medium 10, belt supporters in the form of rollers 11, and a print medium 12.

The first embodiment of the present invention shown in FIG. 1 is constructed so that the recording medium 10 is in the shape of a belt made of an organic photoconductor. The recording medium is extended and supported by the rollers 11 and is driven so as to move in the direction of the arrows in FIG. 1. The first transcription assembly 1, second transcription assembly 2 and transferring portions 1-6, 2-6 are located along the outer peripheral surface of the recording medium 10. The first transcription assembly 1 and the second transcription assembly 2 respectively in the form of toner image-forming units including the cleaners 1-1, 2-1, the eraser 1-2, 2-2, the charging units 1-3, 2-3, the exposure portions 1-4, 2-4, and the developing units 1-3, 2-3, the exposure portions 1-4, 2-4, and the developing units 1-5, 2-5.

In the first transcription assembly 1, the recording medium 10 is cleaned and erased by the cleaner 1-1 and eraser 1-2, and is thereafter charged to a uniform negative polarity by the charging unit 1-3.

Subsequently, the recording medium 10 is exposed to a light signal modulated with a printing signal, by the exposure portion 1-4, whereby a first electrostatic latent image is formed on this recording medium 10. In this example, the electrostatic latent image is subjected to reversal development with a black toner (B) by the developing unit 1-5. The developed toner image is transferred onto the print medium, such as a continuous sheet of paper, by the first transfer unit (in the form of a roller) 1-6 to which a voltage of positive polarity is applied.

The second transcription assembly 2 similarly subjects the recording medium 10 to charging, exposure and development in synchronism with the respective steps of the charging, exposure and development in the first transcription assembly 1 as described above. A toner image thus obtained is superposedly transferred onto the transfer medium 12, superimposed on the toner image for the first transcription assembly 1, by the second transferring unit 2-6. In the second developing unit 2-5 of the second transcription assembly 2, reversal development is performed using a cyan toner (C).

The print medium 12 is conveyed along a substantial U-shaped path, and the second transcription assembly 2 is accommodated in the U-shaped part of the print medium 12 formed along the path of movement thereof. The toner image formed on the front surface of the recording medium 10 by the use of the cyan toner in the second transcription assembly 2, is transferred onto the transfer medium 12 by the second transferring unit 2-6. The timing of the transfer steps of the first and second transcription assemblies are adjusted so that the toner image of the cyan toner may register exactly with the toner image of the black toner transferred by the transferring unit 1-6. Thus, a toner image of two colours is formed on the print medium 12.

After the toner images have been transferred onto the print medium 12 by the corresponding transferring units, the toners remaining on the recording medium 10 are respectively removed by the cleaners 2-1 and 1-1, and remaining charges are subsequently erased by the erasers 2-2 and 1-2. The bicoloured toner picture on the print medium 12 thus obtained is fixed by a heat roller set 13.

In the first embodiment of the present invention, the toner images are formed in succession. Therefore, the embodiment produces the effect that printing in two colours can be executed at the same speed as in the case of unicoloured printing. Moreover, a continuous sheet is employed as the print medium 12. Therefore the embodiment has the effect that, as the print medium 12 need be precisely located only at the positions of the transferring units 1-6, 2-6 in two places, the misregistration of the image on the print medium 12 is prevented in the toner image transfer operation irrespective of the path of the print medium 12 between the two transferring units 1-6, 2-6.

The print medium 12 may be a continuous sheet, for example, and if the continuous sheet has feed holes it can be moved by a sprocket or the like. In this way, misregistration of the image on the print medium can be prevented in the toner image transfer operation. In, the first embodiment of the present invention described above, the second transcription assembly 2 is inside the U-shape which is formed along the path of movement of the print medium 12. Therefore, the embodiment can achieve the effect that no dead space is involved, so the whole apparatus can be constructed compactly.

Since the belt-like recording medium 10 has a simple shape extended and supported by the two rollers 11, the embodiment produces the effect that the replacement of the recording medium is easy.

Figure 2:
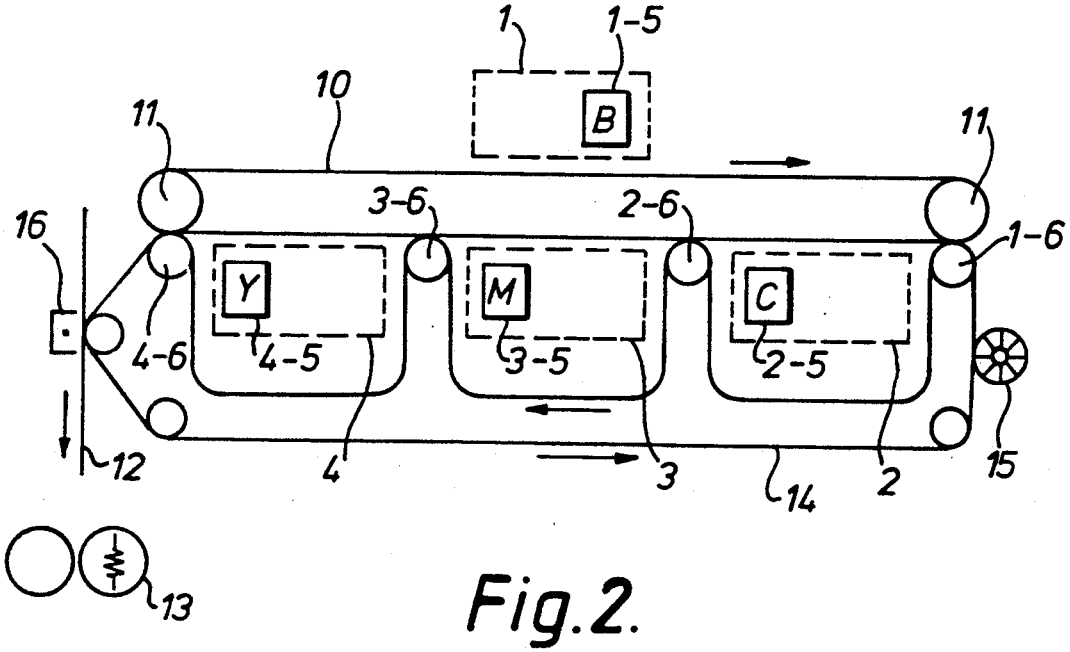
FIG. 2 shows a second embodiment of the present invention, being an apparatus for forming a four-colour image.

FIG. 2 is a block diagram showing the construction of a second embodiment of the present invention. Referring to FIG. 2, there is shown a third transcription assembly 3, a fourth transcription assembly 4, an intermediate transfer medium 14, transferring units 16, 3-6, 4-6, and developing units 3-5, 4-5. The other components are similar to the first embodiment and the same reference numerals are used as in FIG. 1.

In the second embodiment of the present invention shown in FIG. 2, there is the difference from the first embodiment, that toner images are first transferred from the recording medium 10 onto the intermediate transfer medium 14, and the resulting toner images on the intermediate transfer medium 14 are then transferred to the print medium 12, which may be a cut sheet or a continuous sheet. Furthermore, full colour (4-colour) printing is permitted by providing four transcription assemblies.

For these purposes, the second embodiment of the present invention has the intermediate transfer medium 14 in the shape of an endless belt arranged to have a plurality of U-shaped convolutions on one side of the recording medium 10 extended and supported by the two rollers 11. Thus, the intermediate transfer medium 14 interacts with the recording medium 10 at a plurality of sites, 1-6, 2-6, 3-6, 4-6 and is spaced from the recording medium 10 between those sites. In the embodiment illustrated the rollers 11 are, on the lower side of the recording medium 10, and the second transcription assembly 2, third transcription assembly 3 and fourth transcription assembly 4 are spaced apart around the recording medium 10. The first transcription assembly 1 is arranged on the upper side of the recording medium 10, and the other transcription assemblies are respectively arranged inside the plurality of U-shaped parts defined by the intermediate transfer medium 12. The construction of each of the transcription assemblies may be essentially the same as in the case of the first embodiment of the present invention.

In order to clarify the colours of toners for use in development steps, only the developing units 1-5 to 4-5 are denoted by squares, within which the toner colours are indicated for the respective transcription assemblies 1 to 4 shown in FIG. 2.

The intermediate transfer medium 14 is conveyed along an endless path in which the U-shaped convolutions are in a row. In addition, the first developing unit 1-5 of the first transcription assembly 1 used black toner (B) the second developing unit 2-5 of the second transcription assembly 2 was cyan toner (C), the third developing unit 3-5 of the third transcription assembly 3 uses magenta toner (M) and the fourth developing unit 4-5 of the fourth transcription assembly 4 uses yellow toner, whereby the toner images based on the respective toners are formed on the recording medium 10. The toner images formed on the recording medium 10 are successively transferred onto the intermediate transfer medium 14 by the transferring units 1-6, 2-6, 3-6 and 4-6.

Consequently, after the completion of the transfer by the fourth transferring unit 4-6, the toner picture formed on the intermediate transfer medium 14 is a full-colour toner picture in which the toner pictures based on the black toner (B), cyan toner (C), magenta toner (M) the yellow toner (Y) are superimposed one over another. Subsequently, the toner images are transferred onto the print medium 12, for example, a cut sheet by the transferring unit 16, and the transferred images are fixed by the heat roller set 13. Thereafter, the toners remaining on the front surface of the intermediate transfer medium 14 are removed by an intermediate transfer medium cleaner 15.

According to the second embodiment of the present invention described above, full-colour printing can be executed at the same speed as unicoloured printing. Moreover, the intermediate transfer medium 14 onto which the images are transferred from the recording medium 10 is an endless belt extending continuously, so that, in the operations of transferring the toner images in the transferring units 1-6, 2-6, 3-6 and 4-6, mis-registration of the images are prevented as in the first embodiment. Further, unlike the first embodiment, the second embodiment can convey the print medium 12 rectilineraly without it having to follow a complicated path. Therefore, the second embodiment has the effect that, not only a continuous sheet, but also cut sheets can be colour printed without giving rise to mis-registrations.

Figure 3:
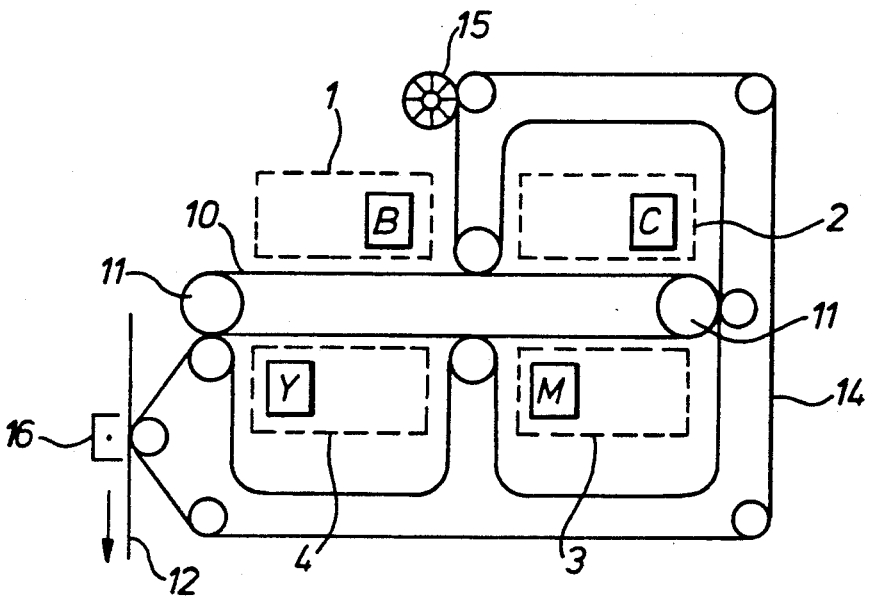
FIG. 3 shows a third embodiment of the present invention, similar to FIG. 2 but with a different intermediate transfer medium geometry.

FIG. 3 is a block diagram showing the construction of the third embodiment of the present invention, in which parts corresponding to those of the second embodiment are indicated by the same reference numerals as in FIG. 2.

The second embodiment of the present invention construction so that the first transcription assembly is located on the side of the recording medium 10 opposite to the side on which the other transcription assemblies are located. In this regard, the third embodiment differs from the second embodiment in that the second transcription assembly 2 is located on the same side as the first transcription assembly 1 with respect to the record medium 10. The operation of the third embodiment is the same as in the case of the second embodiment.

According to the third embodiment of the present invention, there are two transcription assemblies on each side of the recording medium 10. Therefore, the third embodiment permits reduction of the belt length of the record medium 10 to about $\frac{2}{3}$ as compared with the second embodiment, can accommodate the transcription assemblies can be accommodated along a shortened length, so that the whole apparatus can have a more compact construction.

Figure 4:
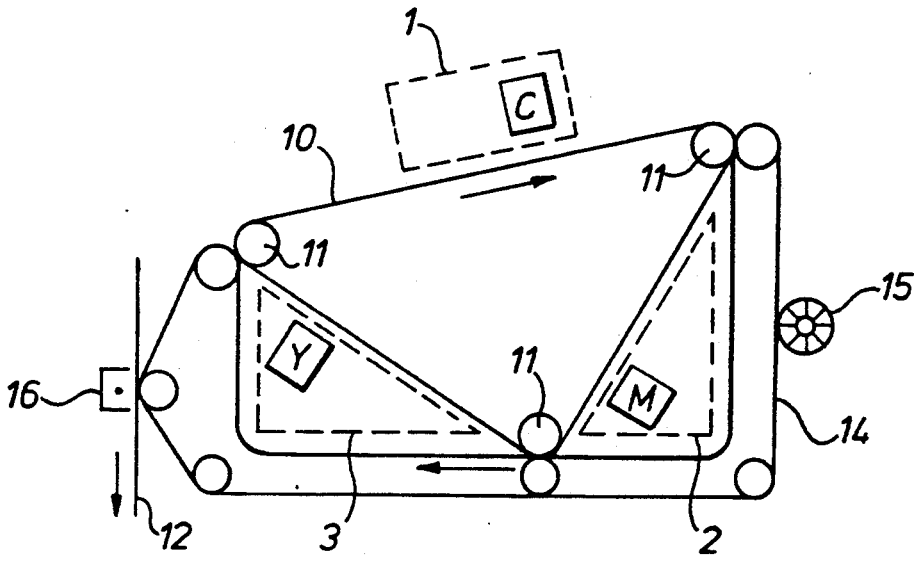
FIG. 4 shows a fourth embodiment of the present invention, with a triangular recording medium loop.

FIG. 4 is a block diagram showing the construction of a fourth embodiment of the present invention, in which parts corresponding to those of the second embodiment are indicated by the same reference numerals as in FIG. 2.

The fourth embodiment of the present invention is constructed so that the recording medium 10 is supported by three rollers 11 so that it has a triangular shape. The intermediate transfer medium 14 moves along a substantially U-shaped path and is arranged so as to enclose two of the sides of the triangle. The first transcription assembly 1, the second transcription assembly 2 and the third transcription assembly 3 are located along the respective sides of the recording medium 10 of triangular shape. The transcription assemblies develop corresponding electrostatic latent images by the use of a cyan tone (C), magenta toner (M) and yellow toner (Y), respectively.

With the fourth embodiment of the present invention as described above, the transcription assemblies are accommodated int eh triangular parts of the intermediate transfer medium 14, not in the substantially U-shaped parts thereof, and the intermediate transfer medium 14 can be brought into the simple structure in which the two triangular shapes are joined and the whole of which defines a single U-shape. Moreover, it is possible to obtain a full-colour picture formed using the cyan toner (C), magenta toner (M) and a yellow toner (Y).

FIG. 4 shows that the recording medium 10 need not be a simple endless loop with two rollers. It can readily be seen that the embodiment of FIG. 4 may be modified by providing four or more rollers 11, provided that the cured parts of the recording medium curve in the same direction. This idea can be progressed further to the equivalent of an infinite number of rollers, when the recording medium is in the form of a single cylinder.

FIG. 4, as for FIGS. 1 to 3, also shows that the sections of the path of the recording medium 10 between the rollers 11 is substantially straight. The transcriptive assemblies then interact with the recording medium 10 at these straight sections.

Figure 5:
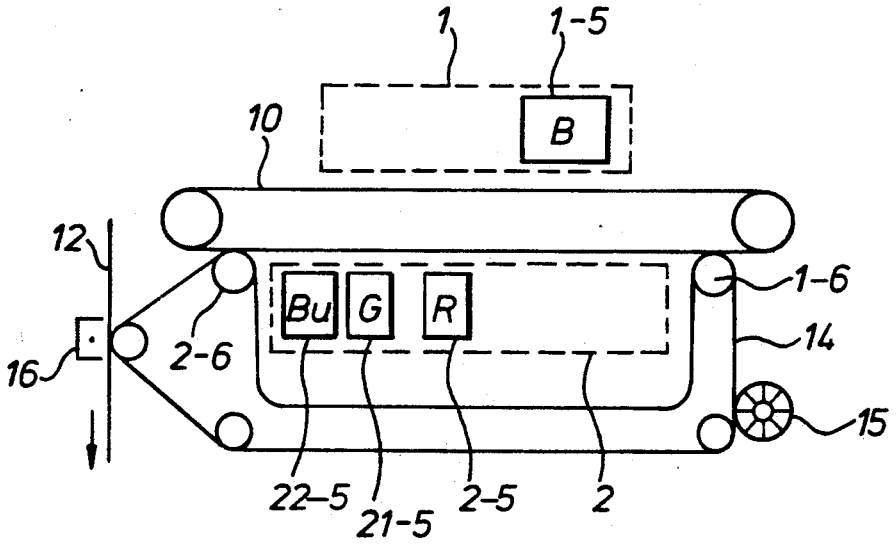
FIG. 5 shows a fifth embodiment of the present invention.

FIG. 5 is a block diagram showing the construction of a fifth embodiment of the present invention. Referring to FIG. 5, that are shown developing units 21-5 and 22-5, and the other reference numerals indicate the same components as in FIG. 4.

The fifth embodiment of the present invention corresponds to a case of executing bicoloured printing, and it is constructed so that the first transcription assembly 1 and second transcription assembly 2 are respectively located on the upper side and lower side of the recording medium 10 and that the second transcription assembly 2 is accommodated inside a U-shaped part of the intermediate transfer medium 14.

The first transcription assembly 1 has the first developing unit 1-5 employing black toner (B), while the second transcription assembly 2 includes a second developing unit 2-5 employing red toner (R). In addition to the second developing unit the second transcription assembly 2 includes further developing units 21-5 and 22-5 which succeed the second developing unit 2-5 and which employ a green toner (G) and a blue toner (Bu), respectively. The second transcription assembly 2 permits the colour of the toner in a developing operation to be selected from among red, green and blue, and it is furnished with the other constituent devices in only one set.

The first transcription assembly 1 provided with the developing unit 1-5 for black toner (B), which toner used with a higher frequency than the toners in the other colours, is installed in a place of large space outside the U-shape of the intermediate transfer medium 14. The developing unit 1-5 is larger in size and has a higher performance than the other developing units 2-5, 21-5 and 22-5, and it has a larger toner capacity. In this fifth embodiment of the present invention a toner image formed on the front surface of the recording medium 10 with black toner (B) by the first transcription assembly 1 is transferred onto the intermediate transfer medium 14 by the transferring unit 1-6. A toner image based on the red toner (R) is formed on the front surface of the recording medium 10 by having the second developing unit 2-5 of the second transcription assembly 2 in its operating state and the other developing units 21-5 and 22-5 in their non-operating states, and it is transferred by the transferring unit 2-6 so as to be superposed on the black toner image on the intermediate transfer medium 14. A toner image in two colours, black and red, is thus formed on the intermediate transfer medium 14 and is transferred onto a print medium such as a cut sheet, 12.

As described before, according to the fifth embodiment of the present invention, the colour of the toner can be changed by selecting one of the second developing unit 2-5 and developing units 21-5 and 22-5. The fifth embodiment can produce the effect that the main printing in black may be arranged to be heavy duty, with the developing unit for black printing in the first transcription assembly 1 located outside the U-shape of the intermediate transfer medium 14, and also selection of the colour toner for bicoloured printing is facilitated by installing the plurality of colour developing units in a row within the second transcription assembly 2.

Of course, the main toner mentioned above can alternatively be a colour toner different from black.

Figure 6:
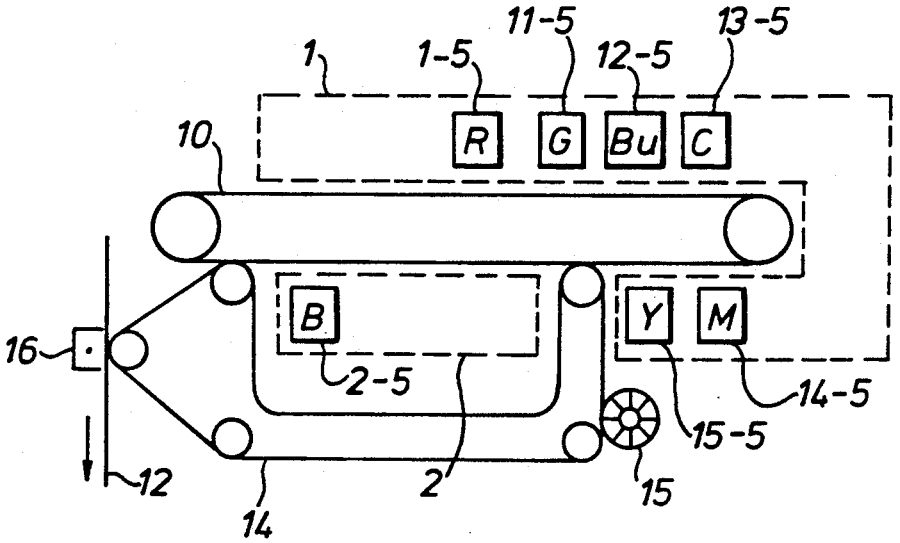
FIG. 6 shows a sixth embodiment of the present invention.

FIG. 6 is a block diagram showing the construction of a sixth embodiment of the present invention. In FIG. 6, there are shown developing units 11-5 to 15-5 with, the other reference numerals indicating the same components as in FIG. 5.

In a similar manner to the fifth embodiment, the sixth embodiment corresponds to the execution of bicoloured printing. The difference between the sixth embodiment and the fifth embodiment is that black printing is executed by the second transcription assembly 2 which is within a U-shape defined by the intermediate transfer medium 14, while the plurality of developing units for colour are in the first transcription assembly 1.

More specifically, the first transcription assembly 1 is arranged in the large space outside the U-shape defined by the intermediate transfer medium 14, and it is constructed to have s developing units for colours, the first developing unit 1-5 being for a red toner (R) and the five developing units 11-5, 12-5, 13-5, 14-5 and 15-5 respectively being for a green toner (G), blue toner (Bu), cyan toner (C), magenta toner (M) and yellow toner (Y), located downstream of the first developing unit. Consequently, the colour toner for transfer can be selected from among six kinds of colour toners.

Thus, with the sixth embodiment, by way of example, bicoloured printing in red and black can be executed by having the first developing unit 1-5 for the red toner in tis operating state and the other developing units in their non-operating states, in the first transcription assembly 1. In a similar way, bicoloured printing in green and black can be executed by having the developing unit 11-5 for green toner in its operating state.

As described above, according to the sixth embodiment of the present invention, colour printing is executed by the first transcription assembly, so that the number of colour toners to be selected in the bicoloured printing can be increased.

Figure 7:
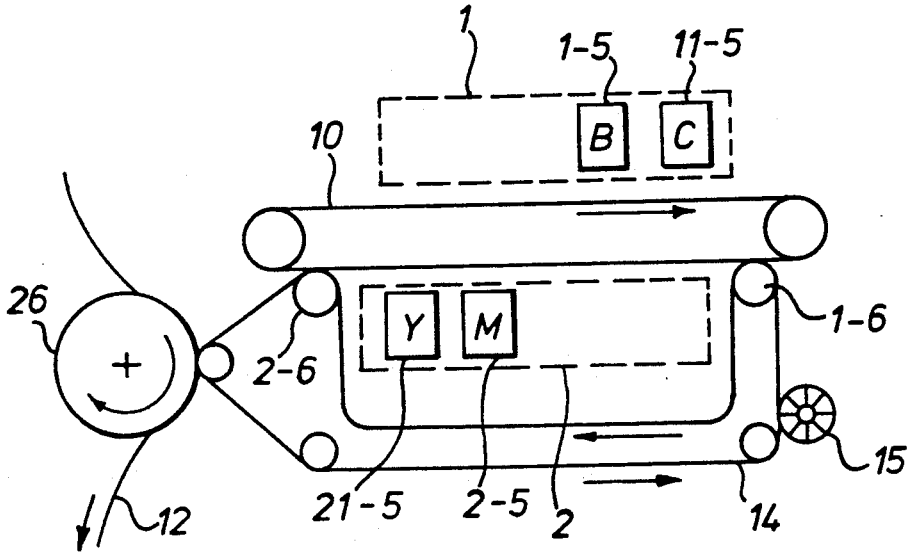
FIG. 7 shows a seventh embodiment of the present invention, being a four-colour apparatus with two transcription assemblies.

FIG. 7 is a block diagram showing the construction of a seventh embodiment of the present invention. In FIG. 7 there is shown a transferring drum 26, and the other reference numerals indicate the same components as in FIGS. 5 and 6.

In the seventh embodiment of the present invention, the first transcription assembly 1 has two developing units, being a first developing unit 1-5 for black toner (B) and a second developing unit 11-5 for a cyan toner (C). The second transcription assembly 2 is located in the U-shaped part of the intermediate transfer medium 14 and also has the two developing units 2-5 and 21-5 respectively for a magenta toner (M) and a yellow toner (Y).

The seventh embodiment can execute full-colour printing through the following operation thereof:

Initially, as the first step, the two developing units 1-5 and 2-5 are brought into their operating states, so that a toner image in two colours based on black toner (B) and magenta toner (M) is formed on the front surface of that part of the intermediate transfer medium 14 which has passed the second transferring unit 2-6. The bicoloured toner image is transferred onto the print medium 12 which is a cut sheet wound around the transferring drum 26.

Subsequently, at the second step, the other two developing units, 11-5 and 21-5 are brought into their operating states, so that a toner image in two colours based on cyan toner (C) and yellow toner (Y) is formed on the front surface of that part of the intermediate transfer medium 14 which has passed the second transferring unit 2-6. This toner image is transferred onto the print medium 12 on the transferring drum 26, to be superimposed on the bicoloured image in black toner (B) and magenta toner (M). Thus, a full-colour image can be printed on the print medium 12.

Since the intermediate transfer medium 14 has a single U-shape, the seventh embodiment of the present invention as described above has the effect that printing by the whole apparatus can be executed at a speed which is a half of the speed of unicoloured printing, but which is a speed which is double the speed of some known full-colour printing systems.

Figure 8:
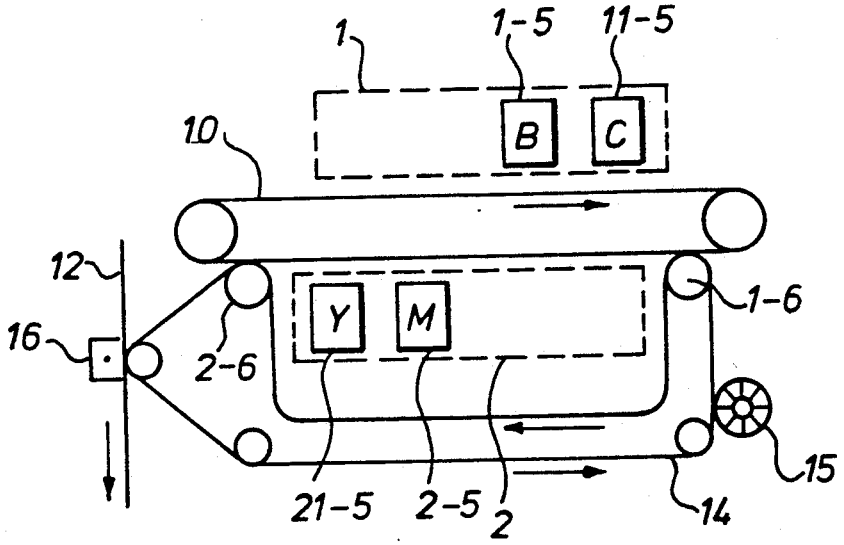
FIG. 8 shows an eighth embodiment of the invention, being a modification of the embodiment of FIG. 7.

FIG. 8 is a block diagram showing the construction of the eighth embodiment of the present invention. Components in FIG. 8 which are identical to those of the other figures are indicated by the same reference numerals.

The eighth embodiment of the present invention differs from the seventh embodiment in that, in the seventh embodiment, the print medium 12 is wound round the transferring drum 26 and receives bicoloured toner images twice from the intermediate transfer medium 14 so as to obtain a full-colour image, in the eighth embodiment a full-colour picture is formed on the intermediate transfer medium 14 and is transferred onto the print medium 12 in a single operation.

The eighth embodiment executes full-colour printing with the following operation.

Initially, as a first step, the two developing units 1-5 and 2-5 are brought into their operating states, so that a toner image in two colours based on black toner (B) and magenta toner (M) is formed on the front surface of that part of the intermediate transfer medium 14 which has passed the second transferring unit 2-6. The bicoloured toner image is carried back to the position of the first transferring unit 1-6 due to the movement of the intermediate transfer medium 14.

Then, the intermediate transfer medium cleaner 15 is held in its non-operating state, (i.e. it is held out of contact with the intermediate transfer medium 14), thereby preventing the toner image from being erased.

Subsequently, as a second step, the other two developing units 11-5 and 21-5 are brought into their operating states. Since the first transferring unit 1-6 transfers a toner image of a cyan toner (C) to be superimposed on the bicoloured toner picture, a toner picture in three colours is formed on the front surface of the intermediate transfer medium 14, and this tricoloured toner image is carried to the position of the second transferring unit 2-6 which transfers a toner image of a yellow toner (Y) to be superimposed on the tricoloured toner image.

Thus, a toner image in four colours, i.e. a full-color toner picture is formed on the front surface of the intermediate transfer medium 14. The quadri-coloured toner picture is transferred onto the print medium 12 by the transferring unit 16. Thereafter, toner of any colour remaining on the front surface of the intermediate transfer medium 14 is removed by the intermediate transfer medium cleaner 15.

According to the eighth embodiment of the present invention as described above, a full-colour toner image can be formed on the front surface of the intermediate transfer medium 14. The embodiment has the advantage that the transportation of the print medium 12 is easier, as compared with the system in which the print medium 12 is wound round the transferring drum 26. Moreover, the print medium 12 may be a continuous sheet. Since a full-colour image is formed on the front surface of the intermediate transfer medium 14, the eighth embodiment of the present invention has the further advantage that misregistrations of the toner images are less likely and the whole apparatus can be more compact, than when the image is formed on the print medium 12 by the transferring drum 26.

Although there is a decrease in printing speed, as compared with the second embodiment, the size of the apparatus is reduced. For this reason, the eighth embodiment is presently preferred.

Figure 9:
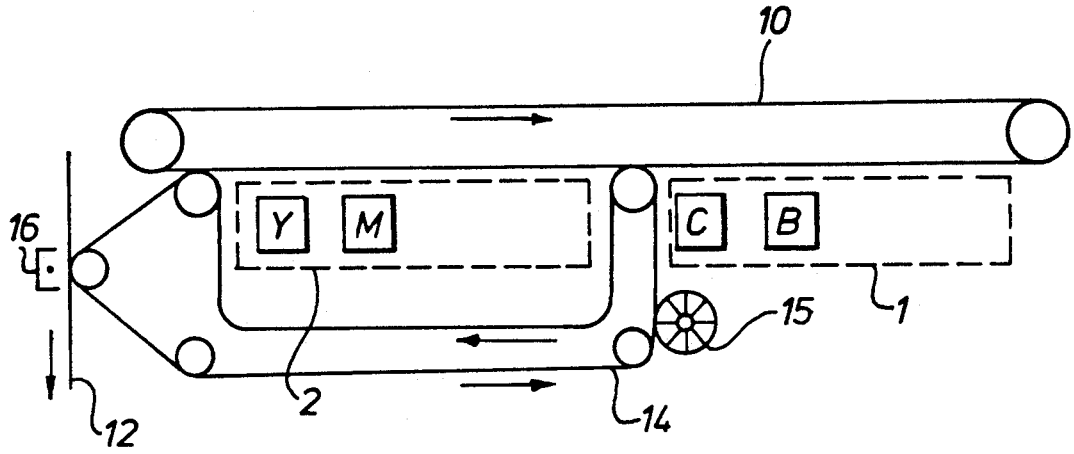
FIG. 9 shows a ninth embodiment of the invention, similar to FIG. 8 but with a different geometry.

FIG. 9 is a block diagram showing the construction of a ninth embodiment of the present invention, in which components are identical to those of the other figures that are indicated by the same reference numerals.

The ninth embodiment of the present invention, differs from the eighth embodiment in that the first and second transcription assemblies 1, 2 are on the same side of the recording medium 10.

Thus, in the ninth embodiment, the first transcription assembly 1 and the second transcription assembly 2 are on the lower side of the recording medium 10, which is supported in a horizontal direction. A full-colour toner picture is formed on the front surface of the intermediate transfer medium 14 and is transferred to the print medium 12 as in the eighth embodiment.

In the ninth embodiment of the present invention, no device such as a transcription assembly is on the upper side of the recording medium 10. Therefore, the embodiment has the advantage that the recording medium 10, which is an article of consumption, can be easily replaced.

Moreover, in this embodiment, all the developing units can have the same structure. Therefore, the embodiment also has the advantage that the developing units can readily be changed in compliance with the colours required in the case of, for example, a system in which bicoloured printing is executed by having one developing unit in each of the first transcription assembly 1 and second transcription assembly 2.

Figure 10:
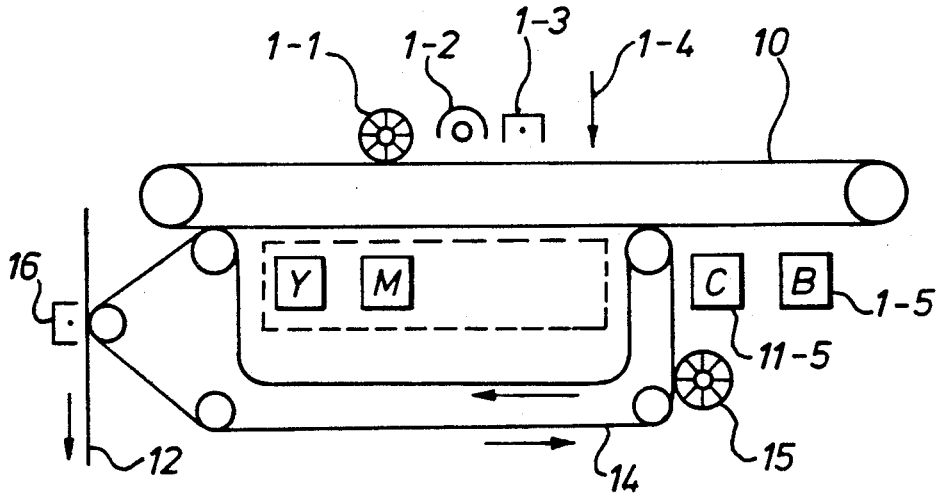
FIG. 10 shows a tenth embodiment of the invention, being a four-colour apparatus with three transcription assemblies.

FIG. 10 is a block diagram showing the construction of a tenth embodiment of the present invention, in which components which are identical to those of the other figures are indicated by the same reference numerals.

The tenth embodiment of the present invention differs from the preceding ninth embodiment in that, of the components of the first transcription assembly 1 in the ninth embodiment, only the developing units 1-5 and 11-5 are on the same side as the second transcription assembly 2, while the cleaner 1-1 eraser 1-2 charging unit 1-3 and exposure portion 1-4 which are the other constituents are on the upper side of the recording medium 10.

In the tenth embodiment as described above, as for the ninth embodiment, all the developing units can have the same structure so that the developing units can be readily changed. Moreover, the tenth embodiment has the advantage that the recording medium 10 can be shortened to make the whole apparatus more compact.

Figure 11:
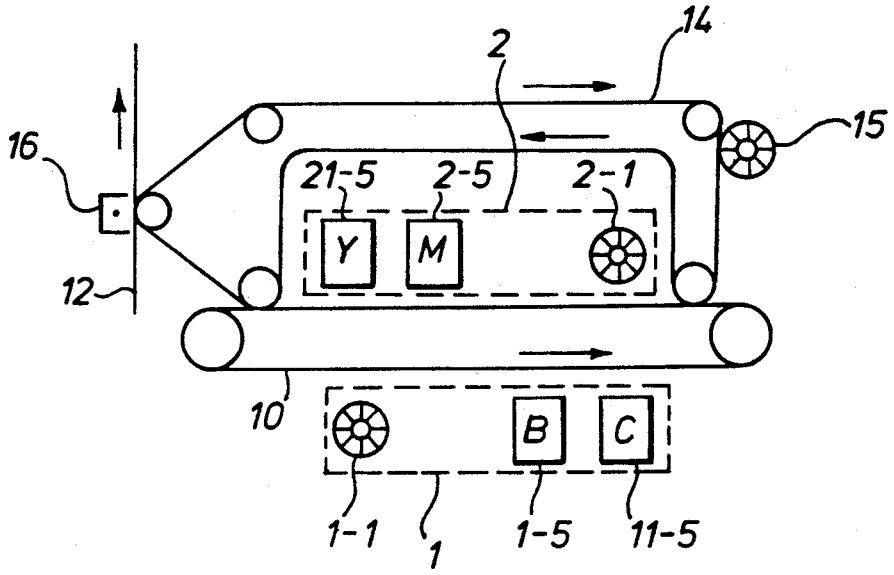
FIGS. 11, 12, 13, 14, 15 and 16 are eleventh to sixteenth embodiments of the invention, related to FIG. 8 but with different geometries.

FIG. 11 is a block diagram showing the construction of an eleventh embodiment of the present invention, in which components which are identical to those of the other figures we indicated by the same reference numerals.

The eleventh embodiment of the present invention, differs from the first to tenth embodiments of the present invention in that the intermediate transfer medium 14 is located over the recording medium 10. In other words, the eleventh embodiment has a construction similar to the eighth embodiment shown in FIG. 8, but in which the intermediate transfer medium 14 is arranged at a vertically inverted position with respect to the recording medium 10.

The recording method is the same as in the eighth embodiment. More specifically, the eleventh embodiment is operated that, in a first step, the two developing units 1-5 and 2-5 are brought into their operating states so as to form a bicoloured toner image on the front surface of the intermediate transfer medium 14, in a second step, the other two developing units 11-5 and 21-5 are brought into their operating states so as to form a full-colour toner image on the front surface of the intermediate transfer medium 14, and that the full-colour image is thereafter transferred onto the print medium 12.

As can be seen from the embodiments thus far described above it is possible, within the present invention, to have a structure in which one transcription assembly, namely, the second transcription assembly 2 is inside the intermediate transfer medium 14 moving along a U-shaped path. Accordingly, when the intermediate transfer medium 14 is underneath the recording medium 10, there is the problem that carrier particles and toner which drop from the developing unit, cleaner etc. of the transcription assembly inside the U-shaped part of the intermediate transfer medium 14 may adhere to the front surface of the intermediate transfer medium 14 and are transported to the transferring portion for the print medium 12, thereby to degrade the quality of the final image.

With the eleventh embodiment of the preset invention as described above, carrier particles, toner etc. which drop from the developing units 2-5 and 21-5 and cleaner 2-1 of the second transcription assembly 2 onto the recording medium 10 are transported by the recording medium 10 and are removed by the cleaner 1-1 of the first transcription assembly 1. Therefore, the embodiment can produce a final picture on the print medium 12 in which the quality is not degraded.

Figure 12:
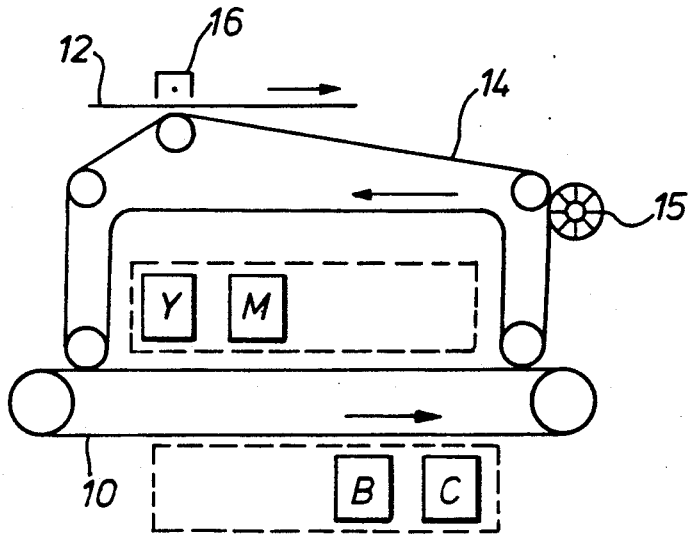

FIG. 12 is a block diagram showing the construction of a twelfth embodiment of the present invention, in which components which are identical to those of the other figures are indicated by the same reference numerals.

The twelfth embodiment of the present invention differs from the preceding eleventh embodiment in that a position at which the toner image is transferred from the intermediate transfer medium 14 onto the print medium 12 is set over the intermediate transfer medium 14.

In the twelfth embodiment, the print medium 12 can run rectilinearly within a horizontal plane, so that the movement of the print medium 12 can be stabilized to prevent a jam occurring.

Figure 13:
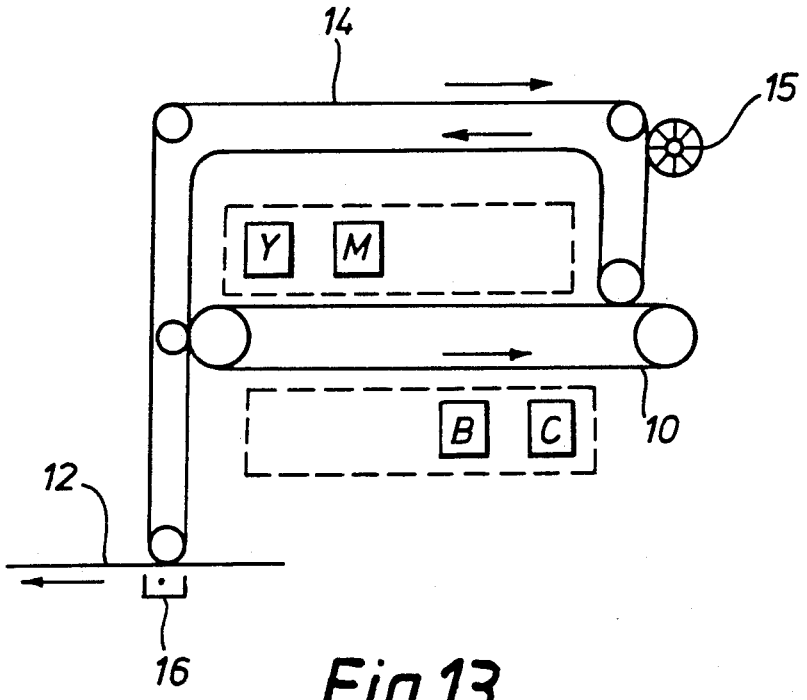

FIG. 13 is a block diagram showing the construction of a thirteenth embodiment of the present invention, in which components which are identical to those of the other figures are indicated by the same reference numerals.

The thirteenth embodiment of the present invention differs from the twelfth embodiment in that the transferring unit which transfers a toner picture from the intermediate transfer medium 14 to the print medium 12 is below the recording medium 10.

Therefore, the thirteenth embodiment is constructed so that the U-shaped part of the intermediate transferring medium 14 is defined over the recording medium 10. The U-shaped part partially extended below the recording medium 10, and the transferring unit 16 is at the lowest position of the intermediate transfer medium 14.

In the thirteenth embodiment of the present invention as described above, the transfer medium 12 runs rectilinearly within a horizontal plane in the same manner as in the twelfth embodiment. Therefore, the thirteenth embodiment has the advantage that the movement of the print medium 12 can be stabilized to prevent a jam occurring. Also, in the thirteenth embodiment, the toner image transferred to the print medium 12 adheres on the upper surface of the transfer print medium 1, so that the print medium 12 can be on and transported by an ordinary conveyor belt after the transferring operation, so a simple transportation system can be used.

Also, the intermediate transfer medium 14 extends to the opposite side of the recording medium 10 means that the position of a transferring print for the transfer medium 12 can be set as desired. The thirteenth embodiment of the present invention therefore has the advantage of versatility of construction of the apparatus in the design thereof.

In contrast, in the twelfth embodiment of the present invention, the toner picture transferred onto the medium 12 adheres to the lower surface thereof, and the transportation of the print medium 12 after the transferring operation requires an arrangement such as pneumatic suction of the print medium 12 from above during its transportation.

Figure 14:
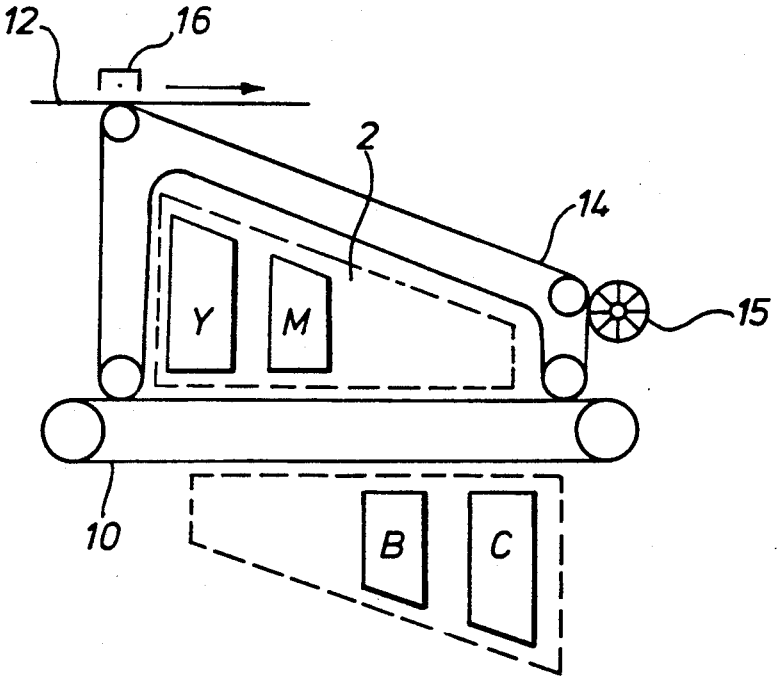

FIG. 14 is a block diagram showing the construction of a fourteenth embodiment of the present invention, in which symbols are identical to those of the other figures are indicated by the same reference numerals.

The fourteenth embodiment of the present invention differs from the first to thirteenth embodiments in that the base of the U-shape defined by the intermediate transfer medium 14 is inclined. The transferring portion for the print medium 12 is disposed at the apical part of the U-shape. This gives an enlarged space for the developing portion of the second transcription assembly 2 which is located inside the U-shaped intermediate transfer medium 14.

In the fourteenth embodiment of the present invention, the space of the developing portion can be increased without appreciably changing the size of the whole apparatus. Therefore, the embodiment has the advantage that developing units of high performances can be employed to execute printing of high image quality.

Figure 15:
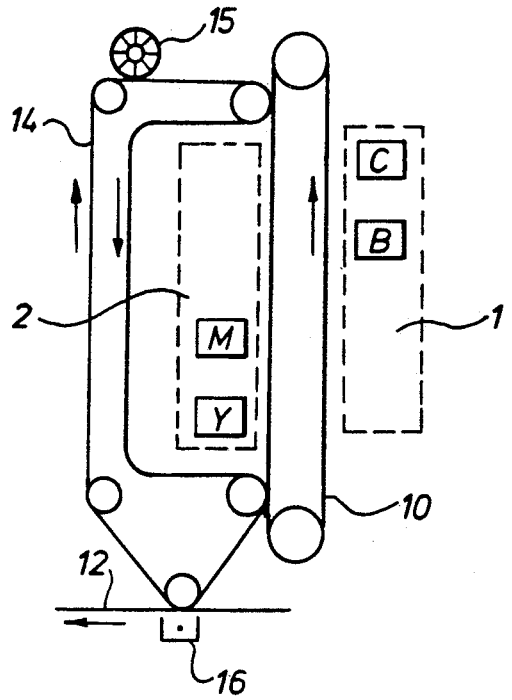

FIG. 15 is a block diagram showing the construction of a fifteenth embodiment of the present invention in which components which are identical to those in the cases of the other figures are indicated by the same reference numerals.

The fifteenth embodiment of the present invention, differs from the first to fourteenth embodiments in that the recording medium 10 extends and is supported in a vertical direction.

The fifteenth embodiment is constructed so that the first transcription assembly 1 and second transcription assembly 2 are on opposite sides of the vertical recording medium 10.

With the fifteenth embodiment of the present invention, the vertical recording medium 10 gives the advantage that toner, carrier particles etc. which drop from the first transcription assembly 1 or second transcription assembly 2, etc. can be prevented from adhering to the recording medium 10.

Also, toner, carrier particles, etc. which drop from the second transcription assembly 2 onto the intermediate transfer medium 14 can be immediately transported out of the U-shape of the intermediate transfer medium 14 by the movement thereof. Therefore, the fifteenth embodiment eliminates the drawback that as in the case of, for example the eighth embodiment shown in FIG. 8, the toners, carrier particles, etc. which have dropped inside the U-shaped part accumulate therein to degrade the image quality.

Figure 16:
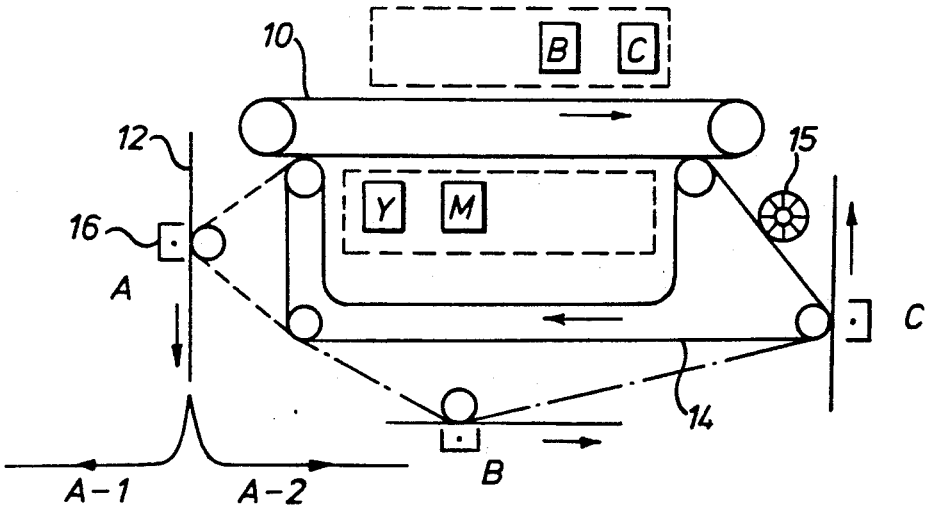

FIG. 16 is a block diagram showing the construction of a sixteenth embodiment of the present invention, in which components which are identical to those in the case of the other figures are indicated by the same reference numerals.

The sixteenth embodiment of the present invention is a modification to the eighth embodiment of the present invention shown in FIG. 8. It differs from the eighth embodiment in the position of a transferring point at which a toner image is transferred from the intermediate transfer medium 14 onto the print medium 12.

The eighth embodiment has the transferring point at a position A in FIG. 16, the sixteenth embodiment sets the transferring point at a position B or a position C.

With the eighth embodiment having a transfer point at position A, the transferring point lies at a lower part of the whole apparatus, and there cannot be a large space below the transferring point when constructing the apparatus. Therefore, the print medium 12, after the image transferring operation, advances while greatly deflecting its course along a path denoted by symbol A-1 or A-2, causing the problem that the transfer medium 12 lacks stability of travel and also the problem that the construction of the apparatus becomes complicated, particularly in the case of the path indicated at A-1, since the toner image, which is not yet fixed, adheres on the lower surface of the print medium 12, and a method of conveying the print medium 12 becomes complicated.

In contrast, if the sixteenth embodiment of the present invention has transferring point B, the print medium 12 can travel rectilineraly in a horizontal plane, so that the travel of the print medium 12 can be stable. On the other hand, if the transferring point C is used, the print medium 12 proceeds upwards in a vertical direction, but the transferring point lies at a lower part of the whole apparatus, there can be a large space above the transferring point, and the course of the print medium 12 after the transferring operation need not be greatly deflected, so that the travel of the print medium 12 can be stabe.

Figure 17:
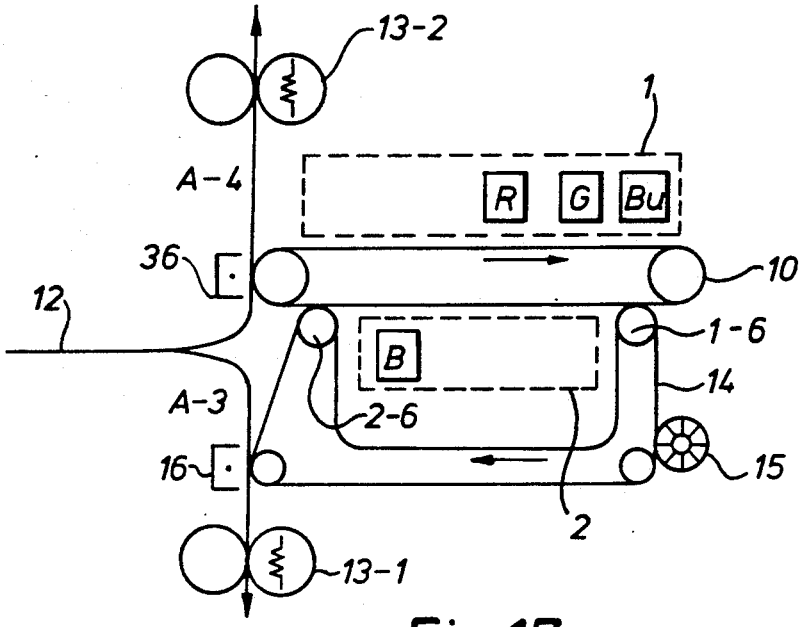
FIG. 17 shows a seventeenth embodiment of the present invention, with two paths for the print medium.

FIG. 17 is a block diagram showing the construction of a seventeenth embodiment of the present invention. FIG. 17 shows a transferring unit 36, and the other components are the same as in the cases of the other figures, and are indicated by the same reference numerals.

The seventeenth embodiment of the present invention differs from the second to sixteenth embodiments of the present invention in that, for unicoloured printing, a toner image is transferred directly from the recording medium 10 onto the print medium 12 without actuating the intermediate transfer medium 14.

In the seventeenth embodiment, the second transcription assembly 2, which includes a developing unit for a black toner (B), is arranged inside the U-shaped part of the intermediate transfer medium 14, and the first transcription assembly 1 includes a plurality of selectable developing units for developments based on different colour toners.

For executing bicoloured printing, based on black toner (B) and a coloured toner, for example, a green toner (G), the seventeenth embodiment is operated so that the transferring units 1-6 and 2-6 are actuated, thereby to form a toner picture in two colours on the intermediate transfer medium 14. The toner picture thus formed is transferred by the transferring unit 16 onto the transfer medium 12 which is conveyed along the path A-3, and the transferred image is fixed by the first heat roller set 13-1.

On the other hand, for black printing or unicoloured printing of, for example, only red toner, the seventeenth embodiment is operated so that neither of the transferring units 1-6 and 2-6 is actuated. The toner image formed on the recording medium 10 is transferred by the transferring unit 36 onto the print medium 12 which is conveyed along the path A-4, and that the transferred picture is fixed by a second heat roller set 13-2.

In the above operation of the seventeenth embodiment, the first transcription assembly 1 is held in its non-operating state for black printing.

In the seventeenth embodiment of the present invention, the toner image is transferred directly from the recording medium 10 onto the print medium 12 in the unicoloured printing mode. Therefore, as compared with a case where the toner image is transferred onto the intermediate transfer medium 14 and the transferred picture is thereafter retransferred, the embodiment can reduce the number of transfers, to mitigate degradation of the image and to print an image of high quality on the print medium 12.

Figure 18:
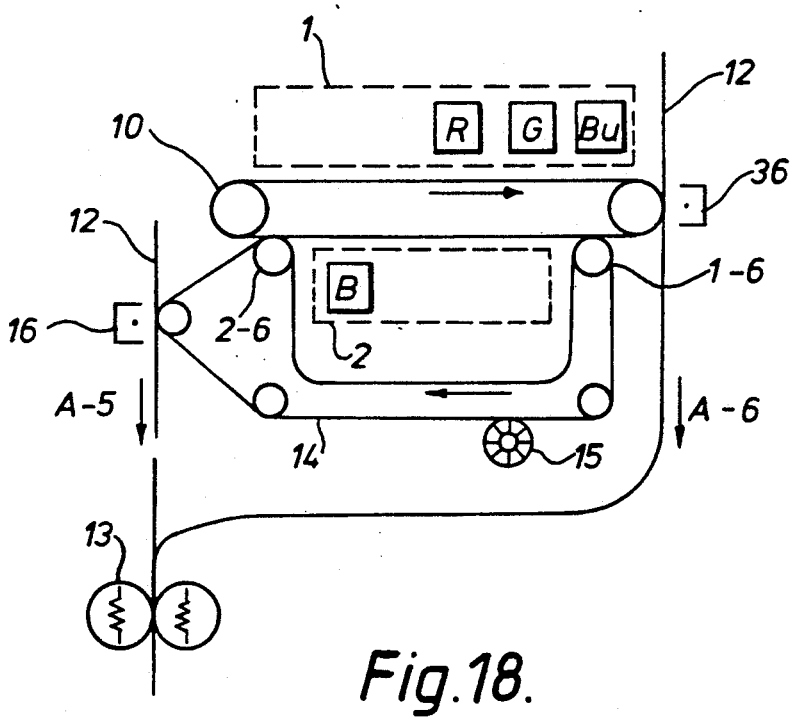
FIG. 18 shows an eighteenth embodiment of the invention, again with two paths for print medium.

FIG. 18 is a block diagram showing the construction of a eighteenth embodiment of the present invention, in which components which are the same as in the case of FIG. 17 are indicated by the same reference numerals.

The eighteenth embodiment of the present invention, differs from the preceding seventeenth embodiment by the position at which a toner image is transferred from the recording medium 10 to the print medium 12.

The eighteenth embodiment of the present invention is constructed so that the position for transferring the toner image from the recording medium 10 to the print medium 12 is located downstream of the first transcription assembly 1 and upstream of the second transcription assembly 2.

In the eighteenth embodiment the print medium 12 is conveyed along a path A-5 for bicoloured printing and along the path A-6 for unicoloured printing. The transferred image on the print medium 12 can be fixed by the heat roller set 13 in both cases. Thus, as compared with the seventeenth embodiment, the eighteenth embodiment needs only one fixing device and the construction of the apparatus is simplified.

Figure 19:
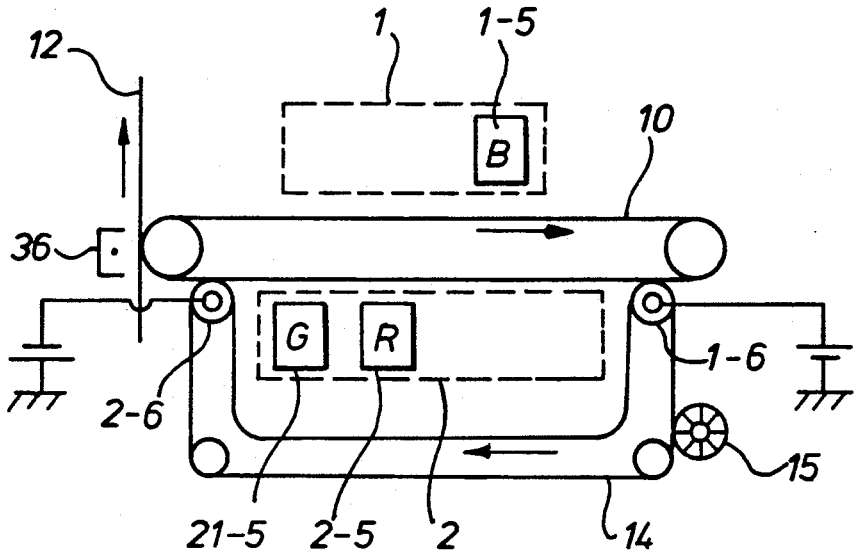
FIG. 19 shows a nineteenth embodiment of the invention, with re-transfer of toner images to the recording medium.

FIG. 19 is a block diagram showing the construction of a nineteenth embodiment of the present invention, in which components which are the same as in the other figures are indicated by the same reference numerals.

The nineteenth embodiment of the present invention, differs from the first to eighteenth embodiments of the present invention in that a toner image transferred from the recording medium 10 to the intermediate transfer medium 14 is retransferred from the intermediate transfer medium 14 to the recording medium 10 in a separate transferring portion located downstream of the transferring portion for the previous transferring operation, and that the retransferred toner image on the recording medium 10 is finally transferred to the print medium 12.

The operation of the nineteenth embodiment will now be described for the case of bicoloured printing.

A toner image formed of a negatively-charged black toner (B) on the recording medium 10 by the first transcription assembly 1 is transferred to the intermediate transfer medium 14 by the transferring unit 1-6 to which a positive voltage is applied, and the transferred toner picture is conveyed to the transferring unit 2-6 together with the intermediate transfer medium 14 which is conveyed along a U-shape.

Following this operation of the first transcription assembly 1, the second transcription assembly 2 performs a developing operation based on, for example, a red toner (R) and forms an image based on the red toner (R) on the recording medium 10. This toner image is transported to the transferring unit 2-6 by the recording medium 10.

The transferring unit 2-6 has a negative voltage applied thereto, which is the reverse of the applied voltage in the first to eighteenth embodiments of the present invention. It transfers the image formed of black toner on the intermediate transfer medium 14, so that it is superimposed on the image formed of red toner on the recording medium 10. Thus, a toner image in two colours of red and black is formed on the recording medium 10. The bicoloured toner image is then transferred onto the print transfer medium 12 by the transferring unit 36.

In addition, for unicoloured printing which employs only black toner (B), red toner (R) or green toner (G), a toner image formed on the recording medium 10 is transferred onto the print medium 12 directly without actuating the transferring units 1-6 and 2-6 in the same manner as in the seventeenth or eighteenth embodiment.

With the nineteenth embodiment of the present invention, as for the seventeenth or eighteenth embodiment, it is possible to reduce degradation of the image at the transferring step for unicoloured printing. Simultaneously, since the same transferring unit and fixing unit can be used for both unicoloured printing and bicoloured printing, the construction of the apparatus can be simplified as understood by comparing FIG. 19 with FIG. 17 or 18.

Figure 20:
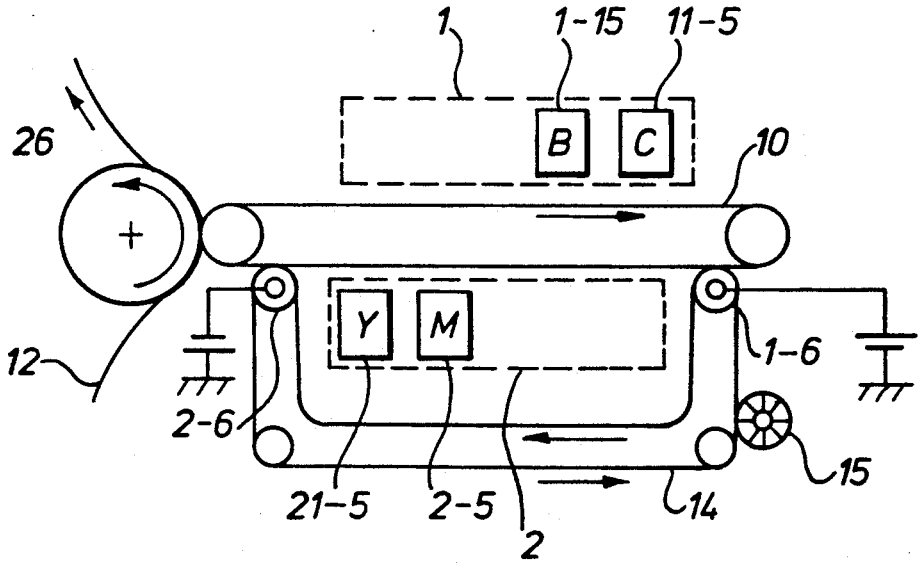
FIGS. 20 and 21 show twentieth and twenty-first embodiments of the present invention, similar to the embodiment of FIG. 19.

FIG. 20 is a block diagram showing the construction of a twentieth embodiment of the present invention, in which components which are the same as in the other figures are indicated by the same reference numerals.

The twentieth embodiment of the present invention achieving full-colour printing by use of the method described for the nineteenth embodiment, in which a toner image in two colours is formed on the recording medium 10, and it corresponds to the seventh embodiment of the present invention in which the toner image is transferred from the intermediate transfer medium 14 onto the print medium 12 as described with reference to FIG. 7.

The twentieth embodiment operates as discussed below and executes the full-colour printing.

Initially, as a first step, the developing units 1-5 and 2-5 are held in their operating states, whereby a toner image in two colours based on black toner (B) and magenta toner (M) is formed on the front surface of that part of the recording medium 10 which has passed through the second transferring unit 2-6. The bicoloured toner image is transferred onto the print medium 12 wound round the transferring drum 26.

Subsequently, as a second step, the other two developing units 11-5 and 21-5 are brought into their operating states, whereby a toner image in two colours based on cyan toner (C) and yellow toner (Y) is formed on the front surface of that part of the recording medium 10 which has passed through the second transferring unit 2-6. The bicoloured toner image is transferred to the print medium 12 which has already been formed with the bicoloured toner image based on black toner (B) and magenta toner (M), to be superimposed on this bicoloured toner image. Thus, a full-colour image can be printed on the print medium 12.

In addition, for unicoloured printing, a toner image on the recording medium 10 is transferred to the print medium 12 directly without actuating the transferring units 106 and 2-6 in the same manner as in the seventeenth, eighteenth or nineteenth embodiment.

With the twentieth embodiment of the present invention, as for the nineteenth embodiment, it is possible to reduce degradation of the image at the transferring step in the unicoloured printing mode. It is also possible to obtain the advantage that, since the same transferring unit and fixing unit can be used for both unicoloured printing and full-colour printing, the construction of the apparatus can be simplified.

Figure 21:
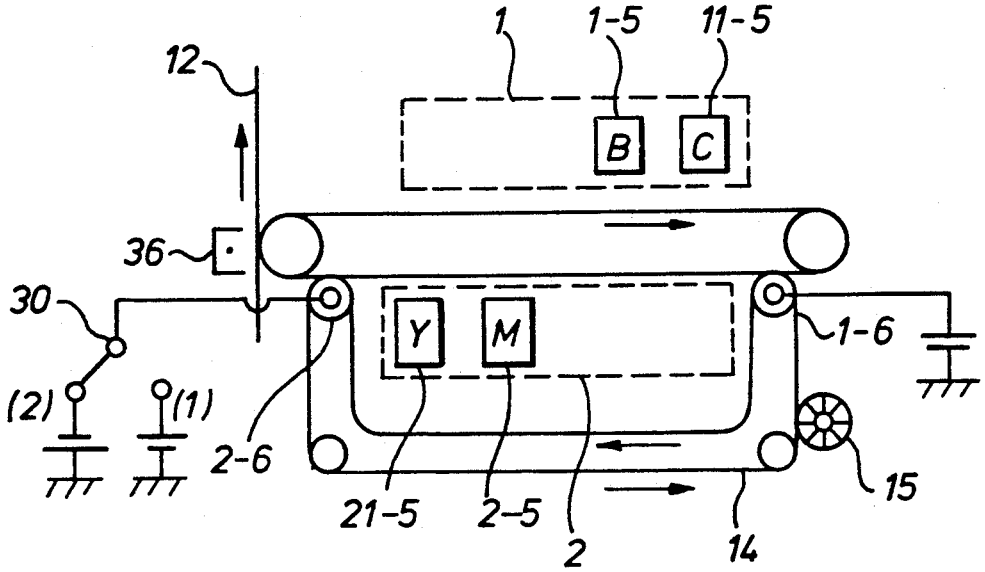

FIG. 21 is a block diagram showing the construction of twenty-first embodiment of the present invention, in which components which are the same as in the other figures are indicated by the same reference numerals.

The twenty-first embodiment of the present invention differs from the twentieth embodiment in that the twentieth embodiment winds the print medium 12 round the transferring drum 26 and transfers bicoloured toner images on the recording medium 10 to the print medium 12 twice, one over another, thereby the twenty-first embodiment forms a full-colour image on the recording medium 10 and transfers the full-colour image directly to the print medium 12.

The twenty-first embodiment of the present invention can execute full-colour printing as follows.

Initially, as a first step, the two developing units 1-5 and 2-5 are put into their operating states, and the transferring unit 2-6 is connected to one side (1) of a switch 30 so as to apply a positive voltage thereto. Thus, a toner image in two colours based on black toner (B) and magenta toner (M) is formed on the front surface of the intermediate transfer medium 14. The bicoloured toner image is transported toward the first transferring unit 1-6 due to the movement of the intermediate transfer medium 14. At this time, the intermediate transfer medium cleaner 15 is in its non-operating state.

Subsequently, second step, the other two developing units 11-5 and 21-5 are into their operating states. Thus, the first transferring unit 1-6 transfers a toner image based on cyan toner (C) onto the intermediate transfer medium 14 to be superimposed on the bicoloured toner image borne thereon, to form a tricoloured toner image on the front surface of the intermediate transfer medium 14. The tricoloured toner image is transported toward the second transferring unit 2-6 together with the intermediate transfer medium 14.

The second transferring unit 2-6 now has its applied voltage held at a negative voltage from the second side (2) of the switch 30, and the tricoloured toner image on the intermediate record medium 14, is transferred so that it is superimposed on a toner image of yellow toner (Y) on the recording medium 10. Thus, a full-colour toner image is formed on the front surface of the recording medium 10. The toner image is transferred onto the print medium 12 by the transferring unit 36.

The twenty-first embodiment of the present invention described above, has the advantage that the transportation of the print medium 12 is easier than where the print medium 12 is wound round the transferring drum 26.

Figure 22A:
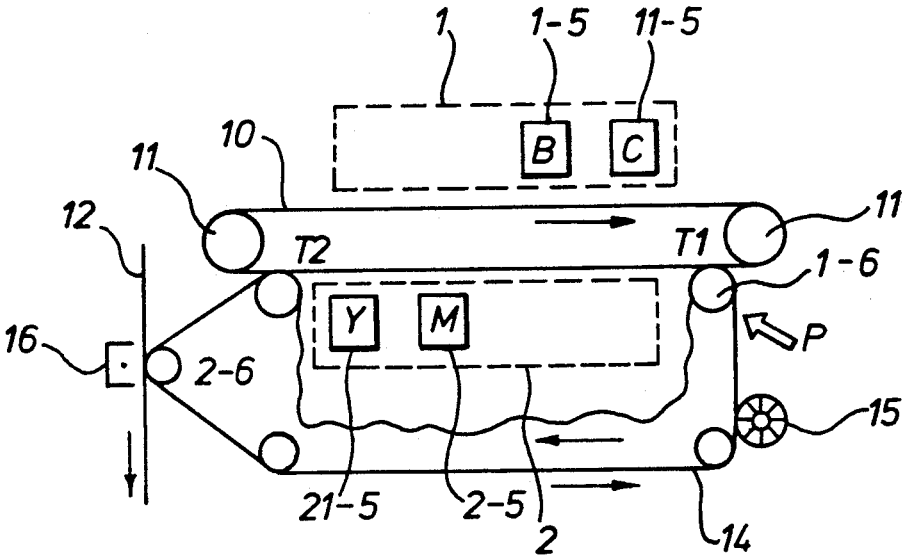
FIG. 22*a* shows a twenty-second embodiment of the invention, being a modification of the embodiment of FIG. 8.
Figure 22B:
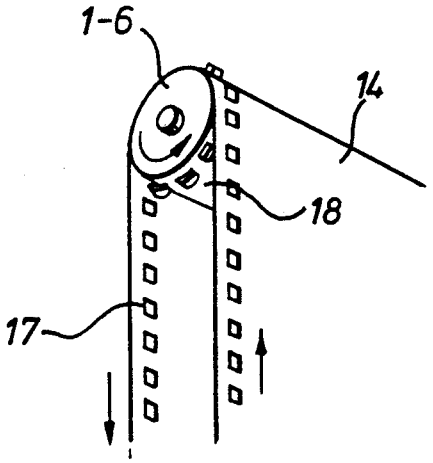
FIG. 22*b* shows an arrangement for ensuring image alignment.

FIGS. 22 (*a*) and (B) are block diagrams showing the construction of a twenty-second embodiment of the present invention. In FIGS. 22 (*a*) and (*b*), there is shown a feed hole 17, and a protrusion 18; the other components being identical to those in other figures and being indicated by the same reference numerals.

The twenty-second embodiment of the present invention relates to the arrangement of the intermediate transfer medium 14 onto which a toner image is transferred from the recording medium 10. The apparatus construction and a printing method illustrated in FIG. 22 (*a*), are generally similar to the eighth embodiment of the present invention shown in FIG. 8.

The twenty-second embodiment is operated so that a first toner image formed on the recording medium 10 by the first transcription assembly 1 is transferred to the intermediate transfer medium 14 at a transferring point T1 by the transferring unit 1-6. That the transferred toner image is transported along the U-shape of the intermediate transfer medium 14 together with the intermediate transfer medium 14. A second toner image is formed on the recording medium 10 by the second transcription assembly 2 and the first and second toner over the other on the intermediate transfer medium 14 at a transferring point T2 by the transferring unit 2-6.

In order to position the first toner image and the second toner image exactly, it is important that the record medium 10 and the intermediate transfer medium 14 have equal speeds and accord perfectly, without any lateral deviation, at the transferring points T1 and T2.

The recording medium 10 is supported by two rollers 11, and is tensioned between the rollers 11 so that it does not sag. Therefore, the recording medium 10 is conveyed precisely over the whole circumference of the belt and an accurate toner image is formed thereon.

On the other hand, the intermediate transfer medium 14 moves in a complicated U-shape while bearing the transferred toner image on its front surface. It is therefore difficult to ensure precise movement over the whole path thereof. However, highly accurate positioning is needed only at the two transferring points T1 and T2. If the intermediate transfer medium 14 can be located precisely at these two points, it need not be tensioned, to have no sag, at other parts of its path, for example, inside the U-shaped part between the points T1 and T2, because it has no function at those parts except to transport the transferred toner image.

Thus is an extreme case, the intermediate transfer medium need not be supported at all inside the U-shaped part. To transport the intermediate transfer medium 14 with such conveyance characteristics, it is desirable to use a forced conveyance mechanism, for example, a feed mechanism based on a sprocket.

FIG. 22 (*b*) shows the transferring unit 1-6 and the intermediate transfer medium 14 when viewed in the direction P indicated in FIG. 22 (*a*). Referring to FIG. 22, (*b*), successive feed holes 17 are provided adjacent the edges of the intermediate transfer medium 14, and the protrusions 18 corresponding to the feed holes 17 of the intermediate transfer medium 14 are provided at the ends of the first transferring unit 1-6, which is in the shape of a roller. Thus, the intermediate transfer medium 14 is movable without being able to slip due to the feed holes 17 and the protrusions 18, when the transferring unit 1-6 is rotated.

The other transferring unit 2-6 has the same structure as that of the transferring unit 1-6, and it feeds the intermediate transfer medium 14 in synchronism with the transferring unit 1-6.

In the twenty-second embodiment of the present invention, the intermediate transfer medium 14 is conveyed by a sprocket arrangement. Therefore, this embodiment has the advantage that the toner image on the recording medium 10 can be superposedly transferred to the intermediate transfer medium 14 to be superimposed on another image without longitudinal or lateral misregistration.

The sprocket arrangement described with reference to FIG. 22(*b*) may be used for transport of the intermediate transfer medium 14, or print medium 12, in the other embodiments. Furthermore, in the above description of the twenty-second embodiment of the present invention, it has been assumed that the intermediate transfer medium 14 is conveyed by a sprocket arrangement. The present invention, however, can use any conveyance device, for example, a timing belt, with which a feeding component and an object to be fed can be matched so as to transport the object to be fed without slippage.

Figure 23:
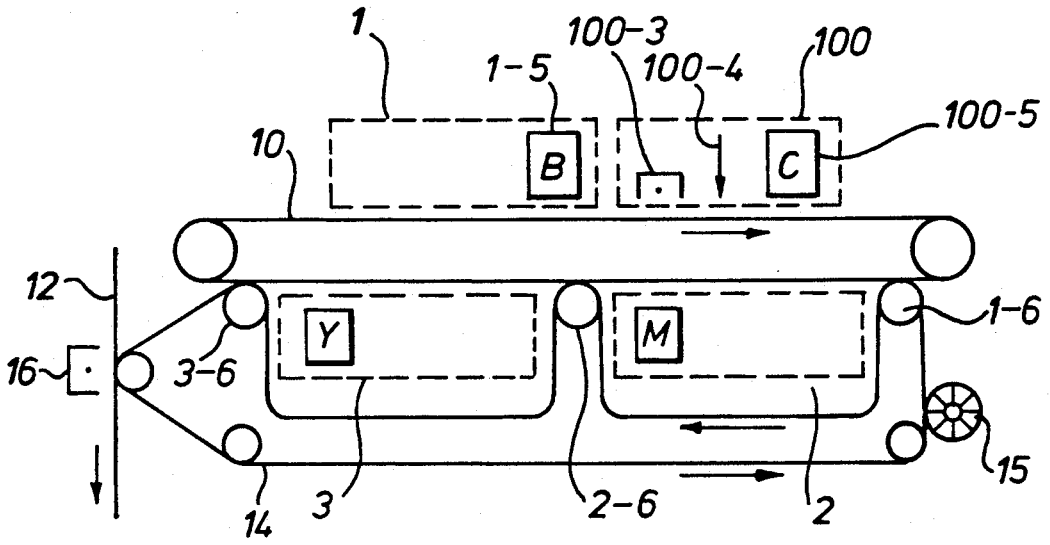

FIG. 23 is a block diagram showing the construction of a twenty-third embodiment of the present invention. In FIG. 23, there is shown a first over-transcription assembly 100, a charging unit 100-3, an exposure portion 100-4 and a developing unit 100-5, while the other components are identical to those of the other figures and are indicated by the same reference numerals.

The twenty-third embodiment of the present invention is constructed such that the first over-transcription assembly 100, which includes in succession the charging unit 100-3, exposure portion 100-4 and developing unit 100-5, is arranged downstream of the first transcription assembly 1 and upstream of the first transferring unit 1-6. The other transcription assemblies 1, 2, 3 are substantially the same as in the second embodiment of the present invention shown in FIG. 2.

In the twenty-third embodiment of the present invention, the first transcription assembly 1 forms a toner image based on black toner (B) on the recording medium 10. Subsequently, the first over-transcription assembly 100 forms a toner image based on cyan toner (C) in the same region as the region in which the toner image of the black toner (B) is formed. Thus, a toner image in two colours based on black toner (B) and cyan toner (C) is formed on the recording medium 10.

At the first over-transcription assembly 100, the recording medium 10, carrying an image in black toner formed by the first transcription assembly 1, is subjected to corona charging by the charging unit 100-3. Subsequently, in order to form the cyan toner image, the recording medium 10 is exposed to light by the exposure portion 100-4, so that it has an electrostatic latent image thereon, which is developed by the developing unit 100-5.

The charging of the recording medium 10 by means of the charging unit 100-3 is performed to adjust the charge potential of the black toner image so as to prevent the cyan toner from adhering to this black toner image, and it is preferable to use a charging unit of the SCOROTRON type which is provided with a grid for controlling a corona current. In addition, the development by the developing unit 100-5 should desirably employ a non-contacting development method so that the black toner image already formed on the recording medium 10 will not be disturbed during this developing.

The bicoloured toner image formed on the recording medium 10 as discussed above, is transferred to the intermediate transfer medium 14 by the transferring unit 1-6, and a magenta toner image and a yellow toner image, formed on the recording medium 10 by the second transcription assembly 2 and the third transcription assembly, are superimposed on the transferred bicoloured image by the transferring units 2-6 and 3-6, respectively. Thus, a full-colour image is obtained on the intermediate transfer medium 14, and that image is transferred to the print medium 12 in the same manner as in the other embodiments.

From comparison with the second embodiment of FIG. 2 or the third embodiment of FIG. 3, the twenty-third embodiment of the present invention described above has a simplified construction. In the second or third embodiments, the intermediate transfer medium 14 have three U-shaped parts justaposed, but the intermediate transfer medium 14 in the twenty-third embodiment presents the configuration in which two U-shaped parts juxtaposed.

Figure 24:
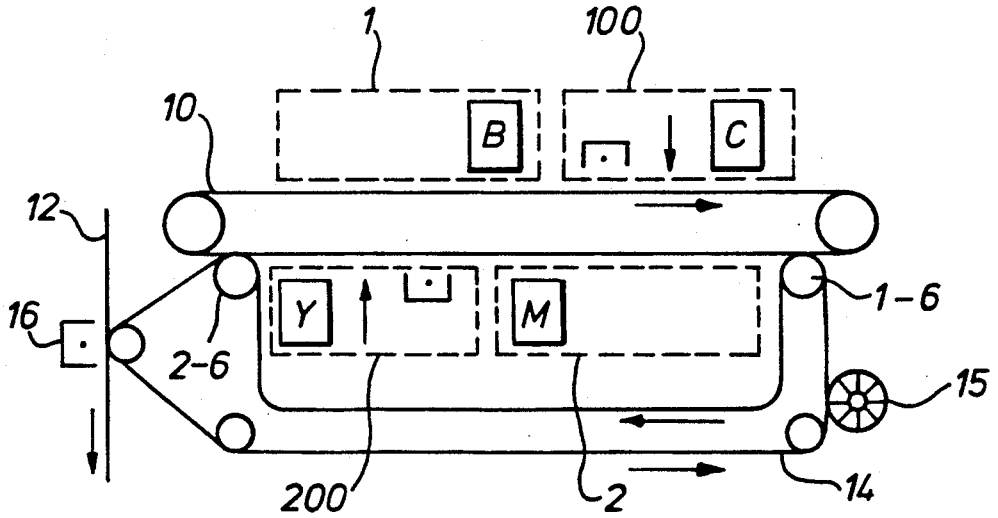

FIG. 24 is a block diagram showing the construction of twenty-fourth embodiment of the present invention. In FIG. 24, there is shown a second over-transcription assembly 200 and the other components are identical to those of FIG. 23 and are indicated by the same reference numerals.

The twenty-fourth embodiment of the present invention, differs from the twenty-third embodiment in that the second transcription assembly and third transcription assembly in FIG. 23 are integral and are accommodated in a single U-shaped part of the path of the intermediate transfer medium 14. Thus, a toner image in two colours based on magenta toner and yellow toner is obtained by a method similar to the method of forming a toner image in two colours based on a black toner and a cyan toner.

In the twenty-fourth embodiment, the first transcription assembly 1 for black toner (B) and the first over-transcription assembly 100 for cyan toner (C) are upstream of the U-shaped part of the path of the intermediate transfer medium 14, while the second transcription assembly for magenta toner (M) and second over-transcription assembly 200 for yellow toner (Y) are inside the U-shaped part of the intermediate transfer medium 14.

In the twenty-fourth embodiment shown in FIG. 24, as in the twenty-third embodiment, a bicoloured toner image based on black toner (B) and cyan toner (C) is formed on the recording medium 10 respectively by the first transcription assembly 1 and the first over-transcription assembly 100, and is transferred to the intermediate transfer medium 14 by the transferring unit 1-6. The transferred toner image is transported to the transferring unit 2-6. The part of the recording medium 10 which has passed through the transferring unit 1-6, has a bicoloured toner image of magenta toner (M) and yellow toner (Y) are respectively formed thereon by the second transcription assembly 2 and second over-transcription assembly 200, and this toner image is transferred to the intermediate transfer medium 14 by the transferring unit 2-6 so as to be superimposed on the bicoloured toner image of black toner (B) and cyan toner (C). Thus, a quadricoloured toner image, i.e. a full-colour image can be obtained on the intermediate transfer medium 14.

In the twenty-fourth embodiment of the present invention described above, the intermediate transfer medium 14 may have a single U-shaped part. Therefore, the embodiment has the advantage of a compact apparatus and the effect that full-colour printing can be executed at the same speed as for unicoloured printing.

Figure 25:
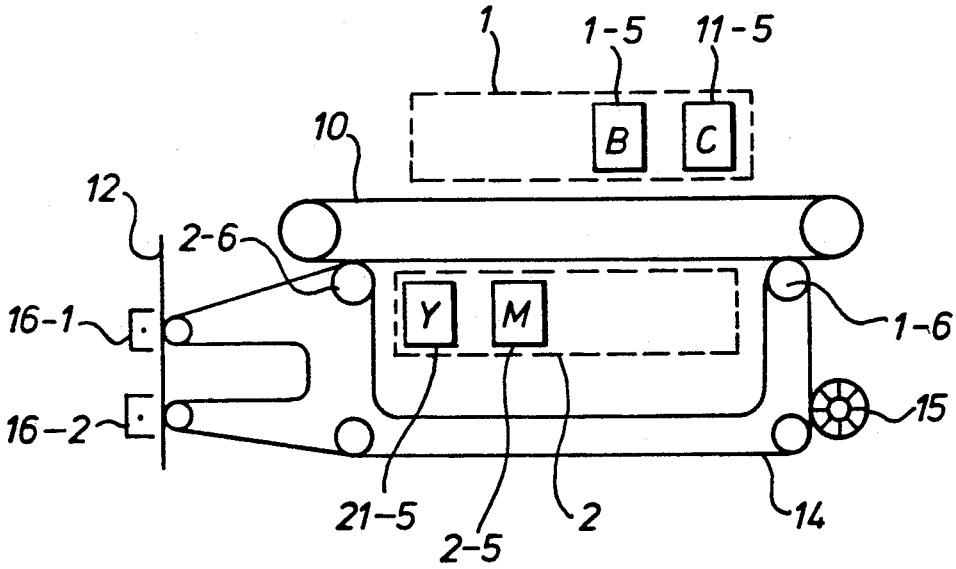
FIGS. 23 to 25 show twenty-third to twenty-fifth embodiments of the present invention.

FIG. 25 is a block diagram showing the construction of a twenty-fifth embodiment of the present invention. FIG. 25, shows transferring units 16-1 and 16-2, and the other components are identical to those in the other figures and are indicated by the same reference numerals.

The twenty-fifth embodiment of the present invention is a modification to the eighth embodiment shown in FIG. 8. The difference from the eighth embodiment is that there are two points at which toner images on the intermediate transfer medium 14 are transferred to the print medium 12 and the intermediate transfer medium 14 defines a U-shape between the transferring units 16-1 and 16-2 disposed at the transferring points.

This twenty-fifth embodiment can execute full-colour printing on the print medium 12 with the following operation:

Initially, as a first step, the two developing units 1-5 and 2-5 are put into their operating states, so that a toner image in two colours based on black toner (*b*) and magenta toner (M) is formed on the front surface of that part of the intermediate transfer medium 14 which has passed through the second transferring unit 2-6.

Subsequently, as a second step, the other two developing units 11-5 and 21-5 are brought into their operating states, so that a toner image in two colours based on cyan toner (C) and yellow toner (Y) is similarly formed on the front surface of the intermediate transfer medium 14. The bicoloured toner image of cyan toner (C) and yellow toner (Y) is formed at a position adjoining the bicoloured toner image of black toner (B) and magenta toner (M) on the intermediate transfer medium 14. Thus the two bicolured toner images are successive.

After the bicoloured toner image of black toner (B) and magenta toner (M) has passed through the position of the transferring unit 16-1, the print medium 12 is conveyed into the transferring portion, and the transferring unit 16-1 is actuated. Thus, the bicoloured toner image of cyan toner (C) and yellow toner (Y) is transferred to the print medium 12. Subsequently, the bicoloured toner image of black toner (B) and magenta toner (M) is transferred to the print medium 12 by the transferring unit 16-2, to be superimposed on the cyan and yellow toner image thereby to form full-colour image on the print medium 12.

In the twenty-fifth embodiment of the present invention, the print medium 12 moves rectilineraly. Therefore, as in the eighth embodiment, the twenty-fifth embodiment has the advantage that the print medium 12 need not be wound round a transferring drum 26. Also, the control of the engagement and disengagement of the intermediate transfer medium cleaner 15 with the intermediate transfer medium 14 need not be performed on each occasion unlike in the eighth embodiment.

In the above description of the embodiments of the present invention, all the printing processes have been assumed, for the sake of convenience, to involve a reversal development method. However, the present invention is also applicable to normal development methods. Moreover, the recording medium 10 may be constructed using an inorganic photoconductor such as selenium or a-Si, apart from the OPC.

The present invention is also applicable to an electrostatic latent image forming system and a magnetic latent image forming system, which are different from the system employing a photoconductor described in the embodiments, and indeed is applicable to any system forming toner images. In addition, although the constructions of the printing assemblies shown in the embodiments of the present invention illustrate standard examples, a large number of modifications are possible with standard techniques.

Each of the transcription assemblies described before can be in the form of an integral cassette, and this has the advantage that the maintenance and inspection of the apparatus can readily be performed.

As described above, according to the present invention, a printer medium or intermediate transfer medium belt is conveyed along at least one U-shaped part, and a transcription assembly for a recording medium is arranged inside the U-shaped part, so that a plurality of toner images can successively be located one over the other in the period of time in which the print medium or intermediate transfer medium passes the recording medium once. It is therefore possible to produce an arrangement on which a multicoloured or full-colour image can be obtained at the same speed as for unicoloured printing.

When the transcription assembly is located in the U-shaped part of a belt-like intermediate transfer medium, a compact apparatus can be constructed. Also, if the print medium or intermediate transfer medium which is conveyed along the complicated U-shape is precisely positioned at transferring portions in contact with the recording medium, misregistrations in printing do not arise even when the print or intermediate transfer medium between the transferring portions is loose. Therefore, the transportation of the print medium or intermediate transfer medium may be simplified, and an image of high quality free from misregistrations can be obtained.

The recording medium itself is preferably a photoconductor, which is an article of consumption, but has a simple structure in which it extends between two rollers. This gives the advantage that a recording medium which has reached the end of its lifetime can be replaced readily.

What is claimed is:

1. An apparatus for forming an image, comprising:

a recording medium having a continuous looped shape, said looped shape having curved parts, and all said curved parts being curved in one direction only;

a plurality of transcription assemblies, each for forming a toner image on said recording medium, said transcription assemblies being spaced apart so as to interact with said recording medium at a corresponding plurality of sequential locations;

an intermediate transfer medium for receiving at least one of said toner images, said intermediate transfer medium interacting with said recording medium at a plurality of sequential toner transfer sites corresponding to and spaced from said locations, and being spaced from said recording medium intermediate said transfer sites, with at least one transfer site being intermediate two of said locations; and a print medium arranged to receive said plurality of toner images to form said image.

2. An apparatus according to claim 1, wherein said intermediate transfer medium and said print medium are arranged to interact such as to transfer said toner images to said print medium.

3. An apparatus according to claim 1, wherein the last of said sequentially spaced transfer sites is arranged to transfer at least one of said toner images to said recording medium, and said recording medium and said print medium are arranged to interact such as to transfer said toner images to said print medium.

4. An apparatus according to claim 1, wherein said recording medium has a straight path between adjacent pairs of said transfer sites.

5. An apparatus according to claim 1, wherein said intermediate transfer medium extends around a corresponding one of said transcription assemblies, in a U-shape, between adjacent pairs of said transfer sites.

6. An apparatus according to claim 1 wherein said recording medium is an endless belt passing around spaced-apart rollers.

7. An apparatus according to claim 6, wherein there are two spaced-apart rollers, and the recording medium extends in a straight path between said rollers.

8. An apparatus according to claim 1 wherein said recording medium is a recording cylinder.

9. An apparatus according to claim 1, wherein each of said transcription assemblies includes a developing unit for developing the toner image formed by the respective transcription assembly.

10. An apparatus according to claim 1, wherein at least one of said plurality of transcription assemblies is arranged to print sequentially toner images of a plurality of colours.

11. An apparatus according to claim 1, wherein said print medium is movable in a selected one of two paths, said print medium on one of said paths being arranged to interact with said intermediate transfer medium, and said print medium on the other of said paths being arranged to interact with said recording medium.

12. An apparatus according to claim 1, having four of said transcription assemblies, and each of said four transcription assemblies is arranged to form a toner image of a respectively different colour.

13. An apparatus according to claim 1, having two of said transcription assemblies, and each of said two transcription assemblies is arranged to form a toner image of a pair of different colours.

14. An apparatus for forming an image comprising:

a recording medium having a continuous looped shape in the form of an endless belt passing around spaced apart rollers, said looped shape having curved parts, and all said curved parts being curved in one direction only;

a plurality of transcription assemblies, each for forming a toner image on said recording medium, said transcription assemblies being spaced apart so as to interact with said recording medium at a corresponding plurality of sequential locations; and a further medium for receiving at least one of said toner images, said further medium interacting with said recording medium at a plurality of sequential toner transfer sites corresponding to and spaced from said locations, and being spaced from said recording medium intermediate said transfer sites, with at least one transfer site being intermediate two of said locations.

15. An apparatus according to claim 14, wherein said recording medium and said further medium are arranged to interact such as to transfer said toner images to said further medium.

16. An apparatus according to claim 14, wherein said further medium is a print medium and there is means adjacent said print medium for developing a toner image transferred from said recording medium.

17. An apparatus according to claim 14, wherein said further medium is an intermediate transfer medium, and the apparatus further includes a print medium arranged to interact with said intermediate transfer medium for receiving said toner image therefrom.

18. A method of forming an image; comprising:

forming a first toner image on a moving recording medium at a first location, said first toner image being formed by a first transcription assembly, said recording medium having a continuous looped shape, said looped shape having curved parts, and all said curved parts being curved in one direction only, said recording medium moving along a path defined by said looped shape;

transferring said first toner image to an intermediate transfer medium at a first transfer site spaced from said first location;

forming a second toner image on said recording medium at a second location spaced from said first location with said first transfer site being between said first and second locations along the path of movement of said recording medium, said second toner image being formed by a second transcription assembly;

causing said intermediate transfer medium to interact with said recording medium at a second transfer site, said second transfer site being spaced such that said second location is between said first and second transfer sites in the path of movement of said recording medium; and transferring said first and second toner images to a print medium.

19. A method according to claim 18, wherein said second toner image is transferred from said recording medium to said intermediate transfer medium at said second site, and the transferring of said first and second toner images to said print medium is from said intermediate transfer medium.

20. A method according to claim 18, wherein said first toner image is transferred from said intermediate transfer medium to said recording medium at said second transfer site, and the transferring of said first and second toner images to said print medium is from said recording medium.

21. A method according to claim 18, wherein said first and second toner images are formed on said recording medium in a first movement of said recording medium around said path, and the first and second transcription assemblies are arranged to form third and fourth toner images respectively on a second movement of said recording medium around said path.

22. A method according to claim 21, wherein said third and fourth toner images are superimposed on said first and second toner images on said intermediate transfer medium, and are subsequently transferred to said print medium.

23. A method according to claim 21, wherein said first and second toner images are transferred from said intermediate transfer medium to said print medium prior to the formation of said third and fourth toner images, and said third and fourth toner images are subsequently transferred to said print medium to be superimposed on said first and second toner images on said print medium .

24. A method according to claim 18, wherein said method is an electrographic process which develops sequentially electrostatic latent images corresponding to each of said first and second toner images.

25. A method of forming an image, comprising:

forming a first toner image on a moving recording medium at a first location, said first toner image being formed by a first transcription assembly, said recording medium having a continuous looped shape in the form of a endless belt passing around spaced apart rollers, said looped shape having curved parts, and all said curved parts being curved in one direction only, said recording medium moving along a path defined by said looped shape;

transferring said first toner image to a further medium at a first transfer site spaced from said first location;

forming a second toner image on said recording medium at a second location spaced from said first location with said first transfer site being between said first and second locations along the path of movement of said recording medium, said second toner image being formed by a second transcription assembly; and causing said further medium to interact with said recording medium at a second transfer site, said second transfer site being spaced such that said second location is between said first and second transfer sites in the direction of movement of said recording medium.

26. A method according to claim 25, wherein said further medium is a print medium, and said second toner image is transferred to said print medium at said second transfer site.

27. A method according to claim 25, wherein said further medium is an intermediate transfer medium, said second toner image is transferred to said intermediate transfer medium at said second transfer site, and said first and second toner images are subsequently transferred from said intermediate transfer medium to a print medium.

28. A method according to claim 25, wherein said further medium is an intermediate transfer medium, said first toner image is transferred from said intermediate transfer medium to said recording medium at said second transfer site, and said first and second toner images are subsequently transferred from said recording medium to a print medium.

29. A method according to claim 25, wherein said first and second toner images are formed on said recording medium in a first movement of said recording medium around said path, and the first and second transcription assemblies form third and fourth toner images respectively on a second movement of said recording medium around said path.

30. A method according to claim 29, wherein said further medium is a first print medium said first and second toner images are transferred to said print medium in the first movement of said recording medium around said path, and said third and fourth toner images are transferred to said print medium in the second movement of said recording medium around said path.

31. A method according to claim 29, wherein said further medium is an intermediate transfer medium, said third and fourth toner images are superimposed on said first and second toner images on said intermediate transfer medium, and are subsequently transferred to said print medium.

32. A method according to claim 29, wherein said further medium is an intermediate transfer medium, said first and second toner images are transferred from said intermediate transfer medium to said print medium prior to the formation of said third and fourth toner images, and said third and fourth toner images are subsequently transferred to said print medium to be superimposed on said first and second toner images on said print medium.

33. A method according to claim 25, wherein said method is an electrographic process which develops sequentially electrostatic latent images corresponding to each of said first and second toner images.

34. A method of forming an image, comprising:

sequentially forming first and second toner images on a moving recording medium; said first and second toner images being formed by first and second transcription assemblies, said first and second transcription assemblies being spaced apart in the path of movement of said recording medium;

transferring said first and second toner images to a further medium such that said first and second toner images are superimposed on said further medium;

sequentially forming third and fourth toner images on said recording medium, said third and fourth toner images being formed by said first and second transcription assemblies respectively; and transferring said third and fourth toner images to said further medium such that said third and fourth toner image are superimposed on said further medium.

35. A method according to claim 34, wherein said further medium is a print medium and said first, second, third and fourth toner images are superimposed on said print medium.

36. A method according to claim 34, wherein said further medium is an intermediate transfer medium, said first, second, third and fourth toner images are superimposed on said intermediate transfer medium, and said first, second, third and fourth toner images are simultaneously transferred to a print medium.

37. A method according to claim 34, wherein said further medium is an intermediate transfer medium, said first and second toner images are transferred from said intermediate transfer medium to a print medium prior to the formation of said third and fourth toner images, and said third and fourth toner images are subsequently transferred from said intermediate transfer medium to said print medium to be superimposed on said first and second toner images.

38. A method according to claim 34, wherein said method is an electrographic process which develops sequentially electrostatic latent images corresponding to each of said first and second toner images.

* * * * *